US005409554A

United States Patent [19]

Leap

[11] Patent Number: 5,409,554

[45] Date of Patent: Apr. 25, 1995

[54] PREVENTION OF PARTICLE EMBRITTLEMENT IN GRAIN-REFINED, HIGH-STRENGTH STEELS

[75] Inventor: Michael J. Leap, Massillon, Ohio

[73] Assignee: The Timken Company, Canton, Ohio

[21] Appl. No.: 122,324

[22] Filed: Sep. 15, 1993

[51] Int. Cl.[6] ..... C21D 8/00; C22F 1/00

[52] U.S. Cl. ..... 148/653; 148/663; 148/333

[58] Field of Search ..... 148/653, 663, 333

[56] References Cited

U.S. PATENT DOCUMENTS

| | | | |
|---|---|---|---|
| 4,170,497 | 10/1979 | Thomas et al. | 148/333 |
| 4,170,499 | 10/1979 | Thomas et al. | 148/663 |
| 4,671,827 | 6/1987 | Thomas et al. | 148/609 |
| 4,938,266 | 7/1990 | Tomita et al. | 148/653 |
| 5,129,966 | 7/1992 | Rao | 148/542 |
| 5,131,965 | 7/1992 | McVicker | 148/334 |
| 5,180,450 | 1/1993 | Rao | 148/579 |

FOREIGN PATENT DOCUMENTS

| | | | |
|---|---|---|---|
| 2245282 | 1/1992 | United Kingdom | 148/653 |

OTHER PUBLICATIONS

Leslie, William C., The Physical Metallurgy of Steels, McGraw-Hill Book Company, 1981, pp. 189-193.

*Primary Examiner*—Scott Kastler
*Assistant Examiner*—Sikyin Ip
*Attorney, Agent, or Firm*—Webb Ziesenheim Bruening Logsdon Orkin & Hanson

[57] ABSTRACT

A process for improving the impact properties of high-strength steels containing grain-refining additions is disclosed along with a product made in accordance therewith. The process comprises a pretreatment step involving heating and hot deformation at a temperature preferably in excess of the solution temperature of the least soluble nitride or carbonitride species present in the steel (T ≧≈1200° C.) followed by accelerated cooling, such as by water quenching, oil quenching, or forced-air cooling. Thereafter, the material is subjected to a subcritical annealing treatment (≈700° C.), austenitized at low-to-moderate temperatures of between about 850°-950° C., and then quenched and tempered.

36 Claims, 18 Drawing Sheets

PREVENTION OF PARTICLE EMBRITTLEMENT IN GRAIN-REFINED, HIGH-STRENGTH STEELS

BACKGROUND OF THE INVENTION

The present invention relates generally to high-strength steels and, more particularly, to a method for increasing the impact toughness of aluminum-killed steels as well as microalloyed steels, with or without aluminum additions. Still more particularly, the invention relates to a method of processing these classes of high-strength steels containing grain-refining additions to prevent particle embrittlement therein.

The deleterious effects of second-phase particles on the toughness of high-strength steels have received a great deal of attention in the art over the past 30 years. This attention has primarily focused on particle embrittlement induced by non-metallic inclusions, aluminum nitride precipitates and large alloy carbides retained through the processing of the steel. More recently, microalloying technology has been employed in the production of grain-refined, 0.1%–0.4% carbon steels that are hardened and then tempered at temperatures below the range associated with the onset of tempered martensite embrittlement. The applicability of this technology has been, however, somewhat limited from the standpoint of restricted carbonitride solubility at carbon contents above 0.2%. A review of the literature suggests that particle embrittlement, which is enhanced by limited precipitate solubility, may have a significant effect on the development of toughness in this class of high-strength steels. The embrittlement may be alleviated via austenitization at high temperatures, but the decreases in precipitate content that alleviate the embrittlement also provide a necessary and sufficient condition for austenite grain growth, thereby defeating the original purpose of the microalloying technology. Considering the potential for second-phase particles to degrade the toughness of tempered martensitic microstructures, very little work has been done in either defining the extent of embrittlement induced by microalloy carbonitrides or developing heat treatments to minimize the effects of particle embrittlement.

The present invention addresses the aspect of particle embrittlement and defines a thermal/thermomechanical process to provide a fine austenite grain size while avoiding or eliminating the effects of particle embrittlement in high-strength steels containing grain-refining additions.

The method of the invention is easily incorporated into a mill processing scheme for the production of annealed machining bars and with only minor modifications to existing production lines. In addition, the process of the invention is suitable for treating quenched and tempered tubes and is most useful in the production of heat-treated forgings.

The present invention provides a method for increasing the impact toughness and grain coarsening resistance of killed steels containing grain-refining elements, particularly the class of steels utilizing aluminum in conjunction with various microalloying elements such as Ti, Nb, and V, either singly or in combination.

SUMMARY OF THE INVENTION

Briefly stated, the present invention is directed to a process for improving the impact properties of high-strength alloy steels containing grain-refining additions such as Al, Ti, Nb, and V, either singly or in combination. The process comprises a pretreatment step involving reheating and hot deformation at a temperature preferably in excess of the solution temperature of the least soluble nitride or carbonitride species present in the steel ($T \geqq \approx 1200°$ C.) followed by accelerated cooling, such as by water quenching, oil quenching, or forced-air cooling. Thereafter, the material is subjected to a subcritical annealing treatment ($\approx 700°$ C.). The material is then hardened by austenitizing at low-to-moderate temperatures of between about 850°–950° C. and then quenched and tempered. The final quench may be in oil or any suitable medium.

Reheating and/or hot deformation at high temperatures allows dissolution processes to decrease the content of coarse precipitates retained through the initial hot rolling of a steel, and accelerated cooling from the reheating temperature limits the amount of precipitation that can occur prior to the $\gamma$ to $\alpha$ transformation. The subsequent subcritical annealing operation provides the necessary conditions for the precipitation of AlN and carbide-rich microalloy carbonitrides in ferrite. Finally, austenitization at low to intermediate temperatures promotes the development of a fine precipitate dispersion and a fine austenite microstructure.

DETAILED DESCRIPTION OF THE INVENTION

Figure 1A:
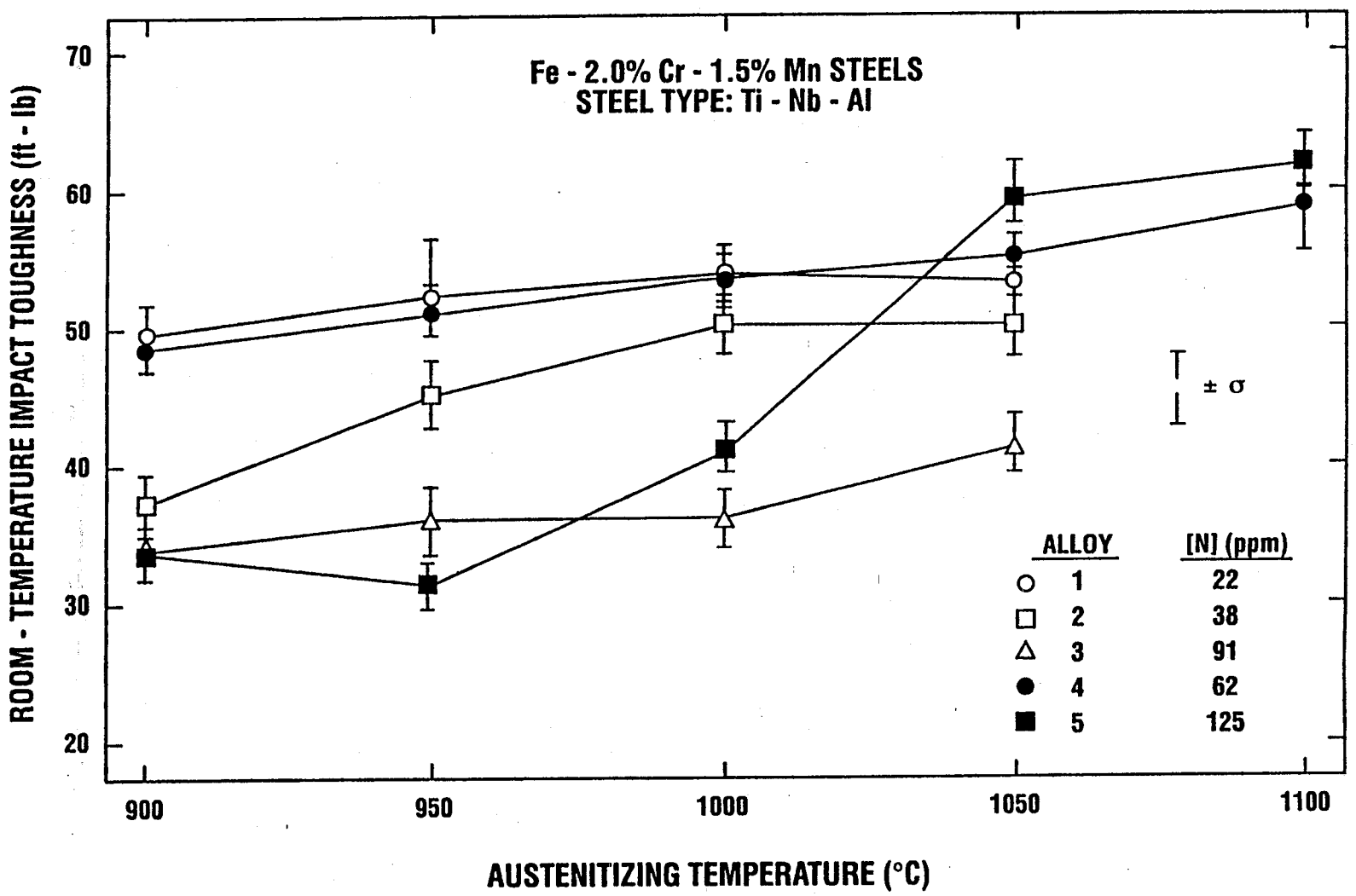
FIG. 1*a* is a graph showing the room-temperature toughness as a function of austenitizing temperature for hot rolled and hardened Alloys 1–5.

As stated above, it is believed that particle embrittlement is the primary factor governing the impact toughness of high-strength steels, such as, for example, killed alloy steels containing one or more grain-refining elements selected from the group comprising Al, Ti, Nb, and V.

Materials and Processing

The compositions of nine experimental alloy steels treated in accordance with the method of the present invention are listed in Tables 1 and 1a. With the exception of a vacuum induction melted (VIM) heat of 4323 steel (Alloy 9), the steels have a nominal, base composition of 0.23% C-1.5% Mn-2.0% Cr with various grain-refining additions, i.e., Ti—Nb—Al, Ti—Al, Nb—Al, and Al. While not shown in Tables 1 and 1a, V may also be employed alone or in combination with Nb, or with Al, or Nb—Al as the grain-refining additions. It is contemplated that the particular grain-refining element or elements selected may be present within certain broad ranges, namely, 0,005–0.05 wt. % Al; 0.005–0.04 wt. % Ti; 0.005–0.08 wt. % Nb and 0,005–0.15 wt. % V. A majority of the steels were melted to nitrogen levels characteristic of commercial electric arc furnace (EAF) steelmaking practices (80–120 ppm N), although several of the Ti—Nb—Al steels were melted to contain lower levels of nitrogen (22–62 ppm). In addition, the steels were all melted to contain a relatively low content of sulfur (0,003–0.007%).

With the exception of two Ti—Nb—Al steels (Alloys 4 and 5), which were obtained directly from production heats, the experimental steels were melted as 100 lb VIM heats. The ingots (≈5.5 in. diameter×≈12 in.) were reheated to between 1230° C. and 1260° C., upset forged to a 6 in. height, cross-forged to a 5.50 in. width and 2.75 in. thickness, and air cooled to room temperature. The ingots were subsequently milled to a 2.50 in. thickness, soaked at ≈1230° C. for 2–3 hours, and hot rolled to 0.63 in. thick plates in six passes. The reduction per pass ranged from 17% to 23%, and the last pass was completed at temperatures in the vicinity of 1000° C.

TABLE 1

| | | Steel Compositions (weight percentages) | | | | | | | | | |
|---|---|---|---|---|---|---|---|---|---|---|---|
| Alloy | Base Composition/Grade | Steel Type | Source | C | Mn | Si | Cr | Ni | Mo | S | P |
| 1 | Fe-1.5% Mn-2.0% Cr | Ti—Nb—Al | VIM | 0.22 | 1.62 | 0.10 | 2.01 | 0.24 | 0.03 | 0.005 | 0.008 |
| 2 | Fe-1.5% Mn-2.0% Cr | Ti—Nb—Al | VIM | 0.23 | 1.50 | 0.10 | 1.98 | 0.24 | 0.03 | 0.005 | 0.005 |
| 3 | Fe-1.5% Mn-2.0% Cr | Ti—Nb—Al | VIM | 0.22 | 1.53 | 0.08 | 1.92 | 0.26 | 0.01 | 0.006 | 0.007 |
| 4 | Fe-1.5% Mn-2.0% Cr | Ti—Nb—Al | Production | 0.22 | 1.51 | 0.04 | 1.95 | 0.26 | 0.04 | 0.003 | 0.012 |
| 5 | Fe-1.5% Mn-2.0% Cr | Ti—Nb—Al | Production | 0.21 | 1.55 | 0.10 | 1.93 | 0.26 | 0.03 | 0.004 | 0.012 |
| 6 | Fe-1.5% Mn-2.0% Cr | Ti—Al | VIM | 0.23 | 1.49 | 0.06 | 1.84 | 0.23 | 0.01 | 0.003 | 0.012 |
| 7 | Fe-1.5% Mn-2.0% Cr | Nb—Al | VIM | 0.23 | 1.51 | 0.06 | 1.92 | 0.24 | 0.01 | 0.004 | 0.012 |
| 8 | Fe-1.5% Mn-2.0% Cr | Al | VIM | 0.23 | 1.48 | 0.06 | 1.88 | 0.30 | 0.01 | 0.004 | 0.012 |
| 9 | 4323 | Al | VIM | 0.23 | 0.81 | 0.26 | 0.83 | 1.79 | 0.26 | 0.007 | 0.007 |

TABLE 1a

| | | Grain-Refining Elements | | | | | |
|---|---|---|---|---|---|---|---|
| Alloy | Base Composition/Grade | Steel Type | Source | Al | Ti | Nb | N (ppm) |
| 1 | Fe-1.5% Mn-2.0% Cr | Ti—Nb—Al | VIM | 0.035 | 0.009 | 0.014 | 22 |
| 2 | Fe-1.5% Mn-2.0% Cr | Ti—Nb—Al | VIM | 0.039 | 0.009 | 0.012 | 38 |
| 3 | Fe-1.5% Mn-2.0% Cr | Ti—Nb—Al | VIM | 0.040 | 0.010 | 0.015 | 90 |
| 4 | Fe-1.5% Mn-2.0% Cr | Ti—Nb—Al | Production | 0.034 | 0.014 | 0.015 | 62 |
| 5 | Fe-1.5% Mn-2.0% Cr | Ti—Nb—Al | Production | 0.027 | 0.012 | 0.020 | 125 |
| 6 | Fe-1.5% Mn-2.0% Cr | Ti—Al | VIM | 0.033 | 0.011 | — | 91 |
| 7 | Fe-1.5% Mn-2.0% Cr | Nb—Al | VIM | 0.027 | — | 0.014 | 91 |
| 8 | Fe-1.5% Mn-2.0% Cr | Al | VIM | 0.025 | — | — | 86 |
| 9 | 4323 | Al | VIM | 0.037 | — | — | 54 |

Heat Treatment

Test specimen blanks were extracted from the mid-plane of the hot-rolled plates in the longitudinal orientation. Initially, specimen blanks were austenitized at temperatures between 900° C. and 1100° C. for one hour, water quenched to room temperature, and tempered at 190° C. for one hour. A series of oversized specimen blanks was also solution treated for one hour at temperatures in the 1100°–1300° C. range and then water quenched or air cooled to room temperature. After this pretreatment operation, half of the specimens were annealed at 700° C. for one hour. The specimen blanks were all subsequently austenitized at temperatures between 900° C. and 1100° C. for one hour, water quenched to room temperature, and tempered at 190° C. for one hour.

Mechanical Testing

The hardness and longitudinal tensile properties of the hot-rolled steels was evaluated subsequent to hardening in the 900°–1100° C. range and tempering at 190° C. All tensile tests were conducted in accordance with ASTM E-8. Impact testing was performed on material hardened after both hot rolling and the application of a pretreatment. The testing of Charpy V-notch specimens (LT orientation) was conducted at room temperature in accordance with ASTM E-23.

Hot-Rolled and Hardened Steels

The tensile properties of the steels are listed with respect to austenitizing temperature in Table 2. In Table 2, the reported values for Alloys 1–3 and Alloys 6–9 represent the average of two tests and three tests, respectively. All specimens were water quenched and tempered at 190° C. for one hour subsequent to austenitization at the indicated temperatures. The percent elongation reported in Table 2 was measured over 1.4 inches. The tensile strength, tensile elongation, and reduction in area values are roughly equivalent in the Fe-0.23% C-1.5% Mn-2.0% Cr steels, although some variability (≈20 ksi) is apparent in the yield strength values for the different steels. In comparison to Alloys 1–3 and 6–8, the 4323 steel (Alloy 9) exhibits slightly lower levels of both strength and tensile ductility. These data also indicate that an increase in austenitizing temperature generally produces a small decrease in the strength, hardness, and tensile ductility of a majority of the steels.

TABLE 2

Summary of the Tensile Properties for the Hot-Rolled and Hardened Steels

| Alloy | Steel Type | Austenitizing Temperature (°C.) | Yield Strength (ksi) | Tensile Strength (ksi) | Elongation (%) | Reduction in Area (%) | Rockwell C Hardness |
|---|---|---|---|---|---|---|---|
| 1 | Ti—Nb—Al | 900 | 179 | 225 | 14.9 | 61.0 | 47 |
| 2 | Ti—Nb—Al | | 188 | 229 | 13.9 | 60.0 | 46 |
| 3 | Ti—Nb—Al | | 190 | 232 | 13.6 | 55.6 | 47 |
| 6 | Ti—Al | 900 | 202 | 230 | 14.4 | 60.8 | 46 |
| 7 | Nb—Al | | 194 | 230 | 14.5 | 61.3 | 46 |
| 8 | Al | | 200 | 228 | 14.4 | 60.8 | 46 |
| 9 | Al | 900 | 184 | 223 | 13.4 | 58.0 | 46 |
| 6 | Ti—Al | 950 | 195 | 228 | 14.1 | 59.5 | 46 |
| 7 | Nb—Al | | 203 | 231 | 14.2 | 58.7 | 46 |
| 8 | Al | | 201 | 230 | 15.0 | 60.5 | 45 |
| 1 | Ti—Nb—Al | 1000 | 176 | 223 | 14.0 | 59.9 | 44 |
| 2 | Ti—Nb—Al | | 179 | 225 | 13.9 | 58.1 | 44 |
| 3 | Ti—Nb—Al | | 183 | 227 | 13.6 | 52.1 | 45 |
| 6 | Ti—Al | 1000 | 195 | 226 | 14.6 | 60.4 | 45 |
| 7 | Nb—Al | | 197 | 227 | 14.2 | 58.8 | 45 |
| 8 | Al | | 193 | 225 | 14.0 | 59.1 | 45 |
| 9 | Al | 1000 | 174 | 217 | 13.1 | 54.4 | 44 |
| 1 | Ti—Nb—Al | 1050 | 172 | 222 | 13.7 | 58.5 | 43 |
| 2 | Ti—Nb—Al | | 179 | 224 | 13.3 | 57.5 | 41 |
| 3 | Ti—Nb—Al | | 182 | 226 | 13.4 | 56.6 | 42 |
| 6 | Ti—Al | 1050 | 195 | 225 | 14.8 | 61.1 | 42 |
| 7 | Nb—Al | | 194 | 225 | 15.6 | 61.4 | 43 |
| 8 | Al | | 195 | 224 | 14.1 | 60.4 | 43 |
| 9 | Al | 1050 | 174 | 219 | 12.2 | 55.6 | 43 |
| 6 | Ti—Al | 1100 | 196 | 227 | 14.4 | 61.9 | 40 |
| 7 | Nb—Al | | 192 | 225 | 13.9 | 59.6 | 41 |
| 8 | Al | | 193 | 223 | 14.0 | 57.1 | 41 |

Figure 1B:
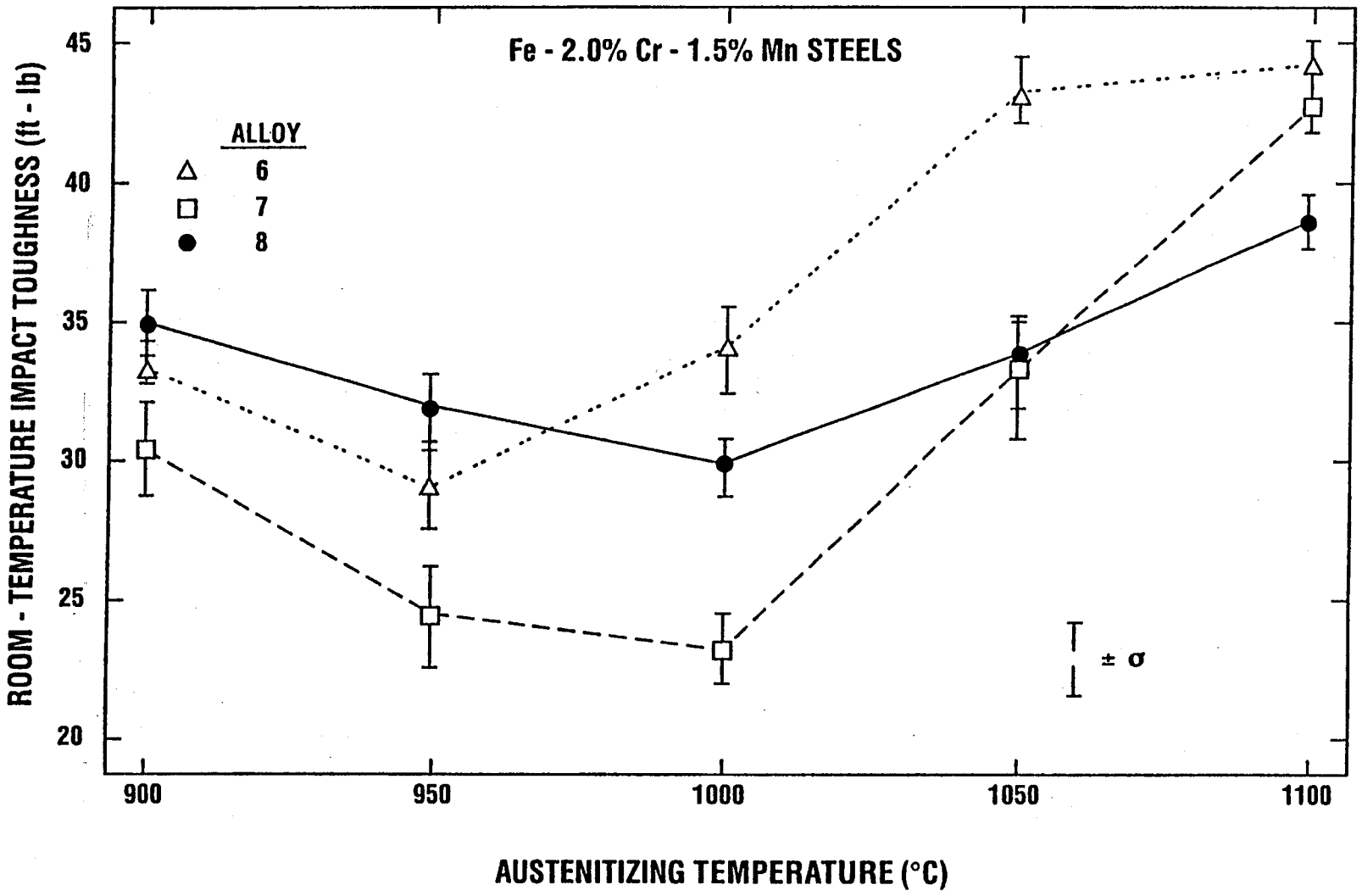
FIG. 1*b* is a graph similar to FIG. 1*a* for Alloys 6–8.

The room-temperature impact toughness of the hot-rolled and hardened steels is shown as a function of austenitizing temperature in FIGS. 1*a* and 1*b*. The low-nitrogen (≈62 ppm) Ti—Nb—Al steels exhibit high levels of impact toughness independent of austenitizing temperature, FIG. 1*a*; however, the alloys containing higher contents of nitrogen, typical of commercial electric furnace steelmaking practices, exhibit relatively low levels of impact toughness subsequent to austenitization at low to intermediate temperatures, and the trend between the impact toughness and austenitizing temperature is inconsistent with generally accepted mechanisms for deformation and fracture in Charpy V-notch specimens. The variation in impact toughness with austenitizing temperature is comparable for the VIM and production steels, but the Ti—Al (Alloy 6), Nb—Al (Alloy 7), and Al (Alloy 8) steels exhibit a decrease in impact toughness with increasing austenitizing temperature prior to an increase in toughness at temperatures above 950° C. (Alloy 6) and 1000° C. (Alloys 7 and 8), FIG. 1*b*. A "trough" in the impact toughness is also apparent in the data for Alloy 5, FIG. 1*a*, although the magnitude of the decrease in toughness over the 900°–950° C. range of austenitizing temperature is relatively small.

The method of the present invention involves the application of a high-temperature, e.g., 1300° C., pretreatment followed by accelerated cooling and a subcritical anneal, e.g., 700° C., to optimize the grain coarsening resistance of the microstructure during final austenitization and also to optimize the impact toughness of the resultant tempered martensitic microstructure.

Application of the Process to the Ti—Nb—Al Steels

Figure 2:
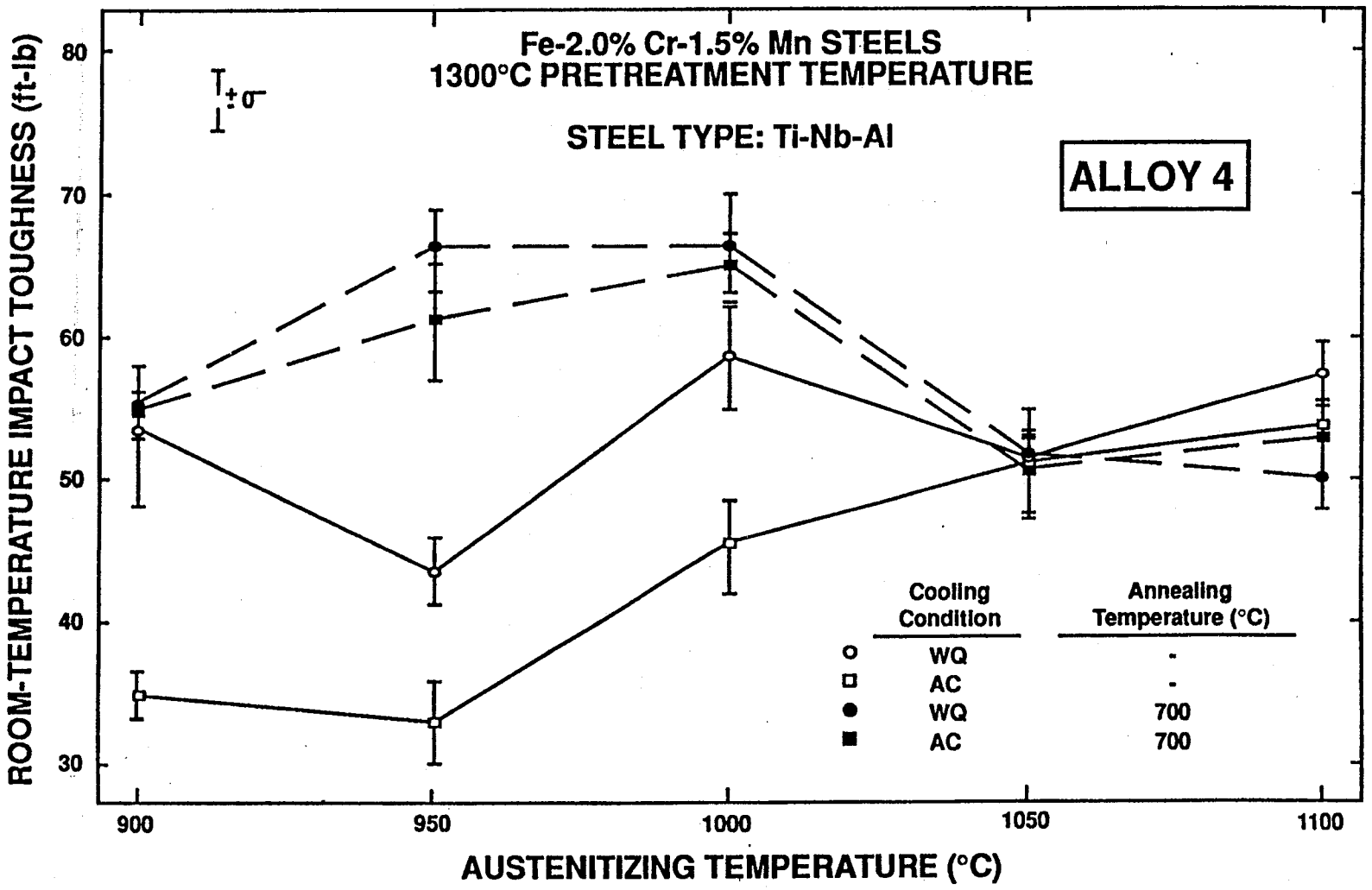
FIG. 2 depicts the room-temperature impact toughness of Alloy 4 as a function of final austenitization temperature for specimens subjected to a 1300° C. pretreatment, with air or water cooling and with or without a subcritical (700° C.) annealing treatment.
Figure 3:
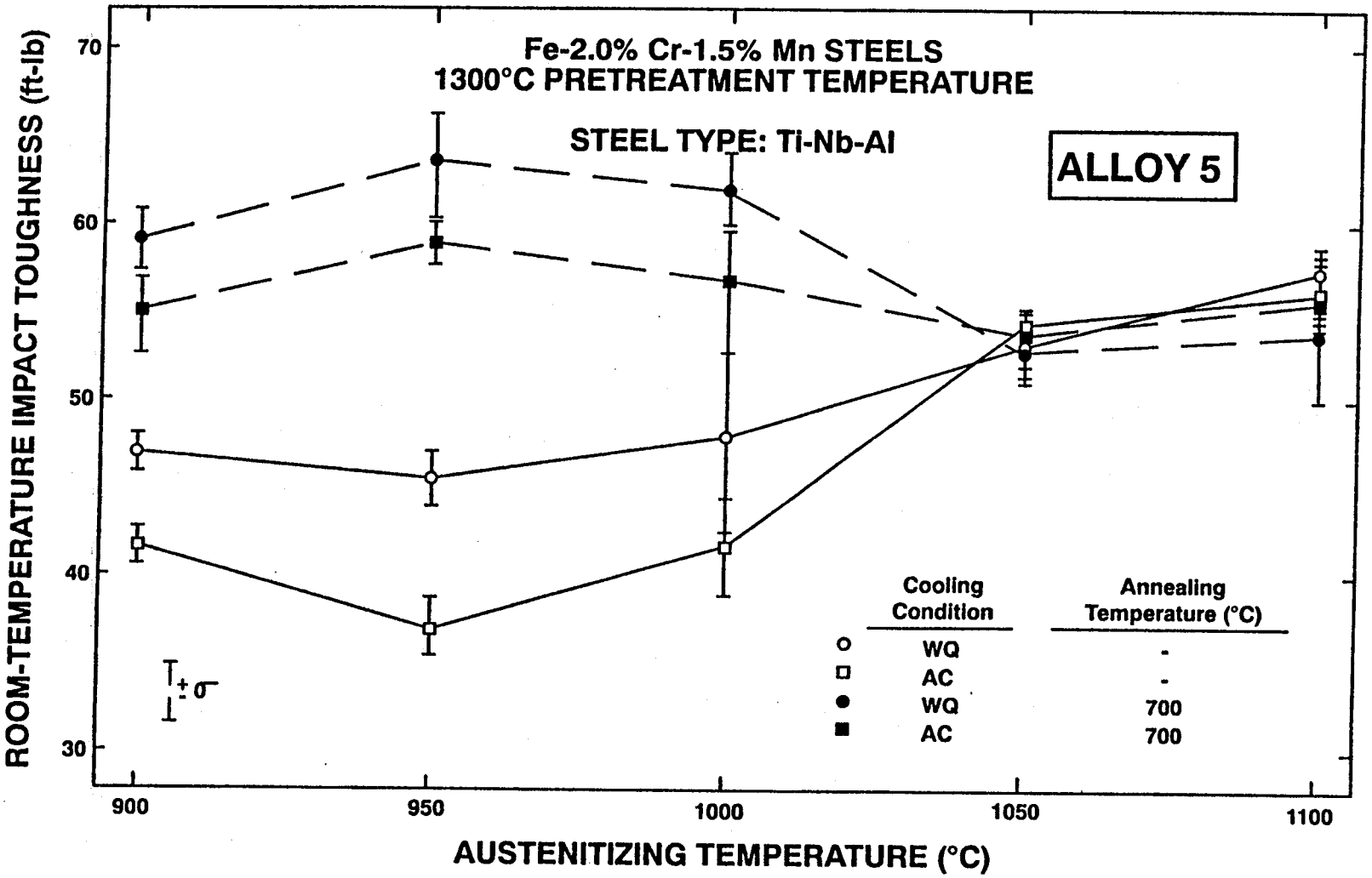
FIG. 3 is a graph similar to FIG. 2 for Alloy 5.

The room-temperature impact toughness is shown as a function of austenitizing temperature for the high temperature, pretreated Ti—Nb—Al steels (Alloys 4 and 5) in Tables 3–4 and FIGS. 2–3. A 1300° C. pretreatment temperature was selected in order to allow the solution of a significant fraction of precipitates while simulating the reheating conditions associated with high-temperature forging. These data suggest that both an increase in the rate of cooling (water quench "WQ" versus air cool "AC") from the pretreatment operation and the application of a subcritical annealing treatment improve the impact toughness of the steels. It is also apparent, particularly in the data for the high-nitrogen steel (Alloy 5), that the impact toughness of the pretreated material exhibits the same general dependence on austenitizing temperature as the hot-rolled steels, i.e., the impact energy increases with austenitizing temperature, if the annealing treatment is omitted from the process. Conversely, the incorporation of a subcritical anneal in the processing scheme optimizes the impact toughness of the material subsequent to hardening at low to intermediate temperatures, on the order of 900°–950° C., for example.

The impact toughness values for the pretreated steels converge at austenitizing temperatures of 1050° C., irrespective of the specific series of treatments applied to the test specimens, and the toughness of the pretreated steels is similar in magnitude to the values for the hot-rolled steels after austenitization in the 1050°–1100° C. range. This type of behavior suggests that microalloy carbonitrides in both the hot-rolled and pretreated steels evolve into dispersions of similar precipitate size and density during high-temperature austenitization. Considering the approach towards equilibrium is relatively rapid and the potential for precipitate coarsening is extremely high at temperatures on the order of 1050° C., it would not be unreasonable to anticipate that the development of a low density of coarse carbonitrides would promote the convergence of the impact toughness towards a constant value for a given steel composition, independent of prior processing history. It should also be noted that the convergence of the impact toughness values for different heat treatments occurs in conjunction with the formation of coarse austenite grain structures in the steels.

TABLE 3

Summary of Room-Temperature Impact Toughness Data for Alloy 4 (0.014% Ti, 0.015% Nb, 0.034% Al, and 62 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 46 | 48.4 ± 1.4 |
| | | | 950 | 46 | 51.0 ± 2.0 |
| | | | 1000 | 45 | 53.5 ± 1.8 |
| | | | 1050 | 43 | 55.0 ± 0.9 |
| | | | 1100 | 41 | 57.8 ± 2.1 |
| 1300 | AC | — | 900 | 44 | 34.5 ± 1.9 |
| | | | 950 | 44 | 32.8 ± 2.9 |
| | | | 1000 | 44 | 45.4 ± 3.5 |
| | | | 1050 | 44 | 51.4 ± 3.6 |
| | | | 1100 | 42 | 53.7 ± 1.2 |
| 1300 | WQ | — | 900 | 45 | 53.7 ± 4.8 |
| | | | 950 | 44 | 43.6 ± 2.4 |
| | | | 1000 | 45 | 58.8 ± 3.8 |
| | | | 1050 | 43 | 51.6 ± 0.8 |
| | | | 1100 | 43 | 57.6 ± 2.3 |
| 1300 | AC | 700 | 900 | 45 | 54.8 ± 1.6 |
| | | | 950 | 45 | 61.5 ± 4.1 |
| | | | 1000 | 44 | 65.2 ± 2.4 |
| | | | 1050 | 44 | 50.2 ± 2.6 |
| | | | 1100 | 44 | 52.9 ± 2.7 |
| 1300 | WQ | 700 | 900 | 44 | 55.9 ± 2.6 |
| | | | 950 | 44 | 66.9 ± 2.6 |
| | | | 1000 | 45 | 66.9 ± 3.4 |
| | | | 1050 | 42 | 51.9 ± 1.4 |
| | | | 1100 | 42 | 50.2 ± 2.1 |

TABLE 4

Summary of Room-Temperature Impact Toughness Data for Alloy 5 (0.012% Ti, 0.020% Nb, 0.027% Al, and 125 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 46 | 33.4 ± 2.2 |
| | | | 950 | 46 | 30.8 ± 1.5 |
| | | | 1000 | 44 | 40.9 ± 1.2 |
| | | | 1050 | 43 | 59.6 ± 2.3 |
| | | | 1100 | 39 | 61.4 ± 1.6 |
| 1300 | AC | — | 900 | 45 | 41.9 ± 1.1 |
| | | | 950 | 44 | 37.2 ± 1.6 |
| | | | 1000 | 45 | 41.7 ± 2.6 |
| | | | 1050 | 45 | 54.0 ± 0.8 |
| | | | 1100 | 45 | 56.0 ± 2.0 |
| 1300 | WQ | — | 900 | 45 | 47.0 ± 1.0 |
| | | | 950 | 45 | 45.5 ± 1.4 |
| | | | 1000 | 45 | 47.8 ± 5.4 |
| | | | 1050 | 44 | 52.5 ± 1.9 |
| | | | 1100 | 44 | 56.6 ± 1.9 |
| 1300 | AC | 700 | 900 | 45 | 54.8 ± 2.2 |
| | | | 950 | 45 | 58.6 ± 1.1 |
| | | | 1000 | 45 | 56.2 ± 3.5 |
| | | | 1050 | 45 | 53.3 ± 1.4 |
| | | | 1100 | 44 | 55.6 ± 1.9 |
| 1300 | WQ | 700 | 900 | 45 | 58.9 ± 1.7 |
| | | | 950 | 45 | 63.1 ± 3.0 |
| | | | 1000 | 45 | 61.6 ± 2.2 |
| | | | 1050 | 44 | 52.3 ± 1.4 |
| | | | 1100 | 43 | 53.1 ± 3.4 |

Application of the Process to the Ti—Al Steel

Figure 4:
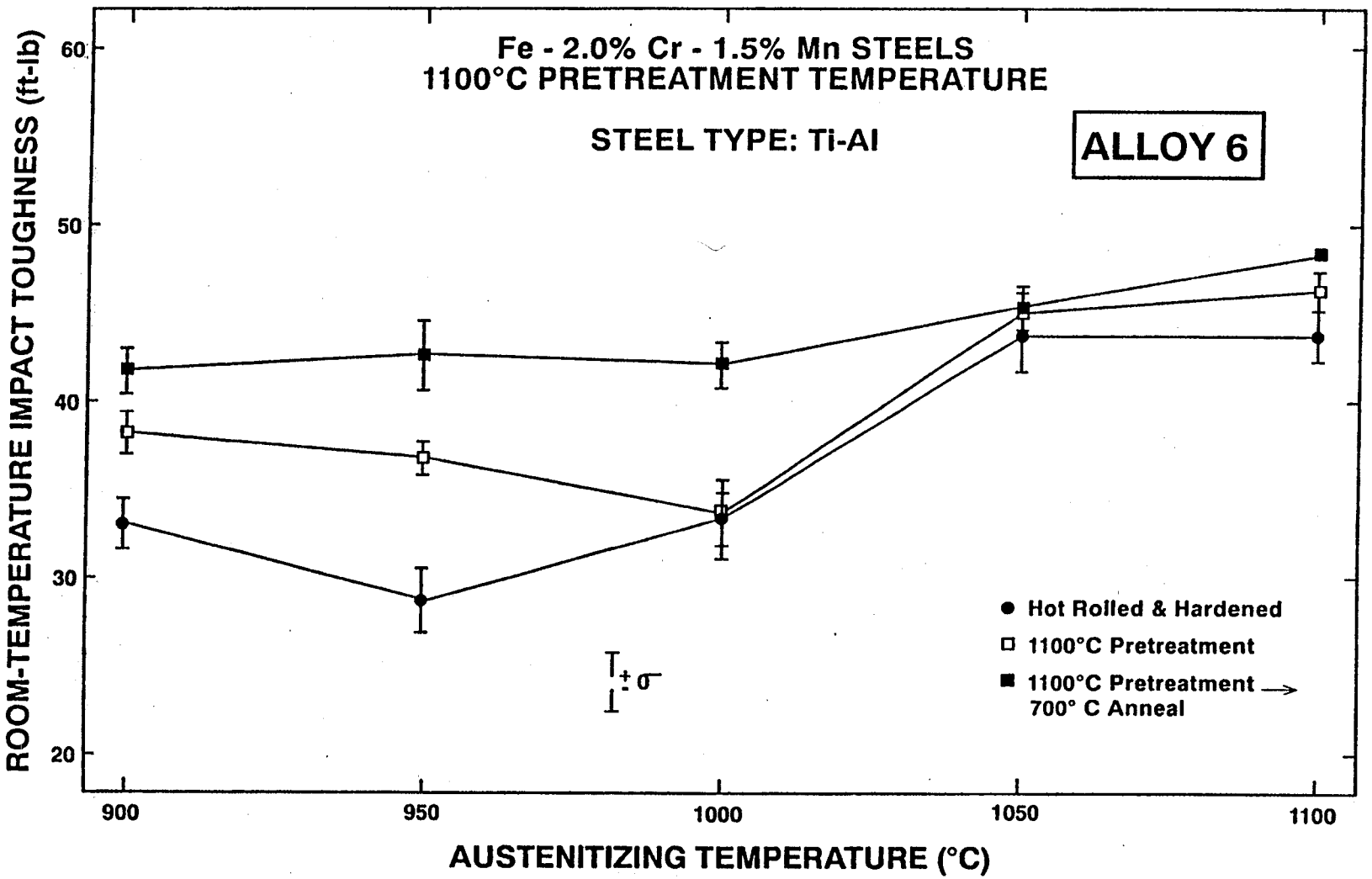
FIG. 4 shows the room-temperature impact toughness of Alloy 6 subsequent to hot rolling and hardening in the 900°–1100° C. range, and the impact toughness of the same alloy pretreated at 1100° C. and subcritically annealed at 700° C.
Figure 5:
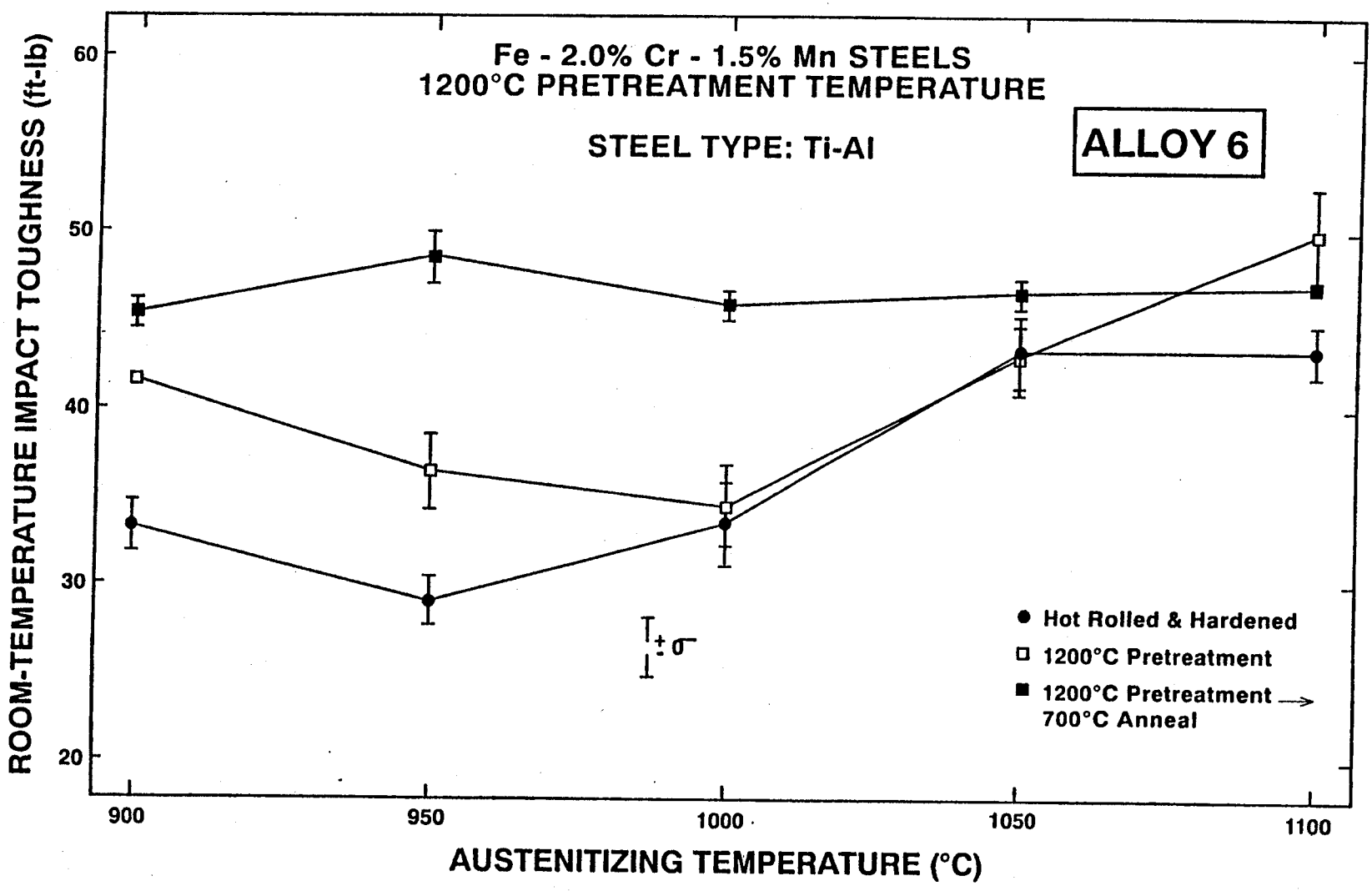
FIG. 5 is a graph similar to FIG. 4 wherein Alloy 6 is subjected to a pretreatment temperature of 1200° C.
Figure 6:
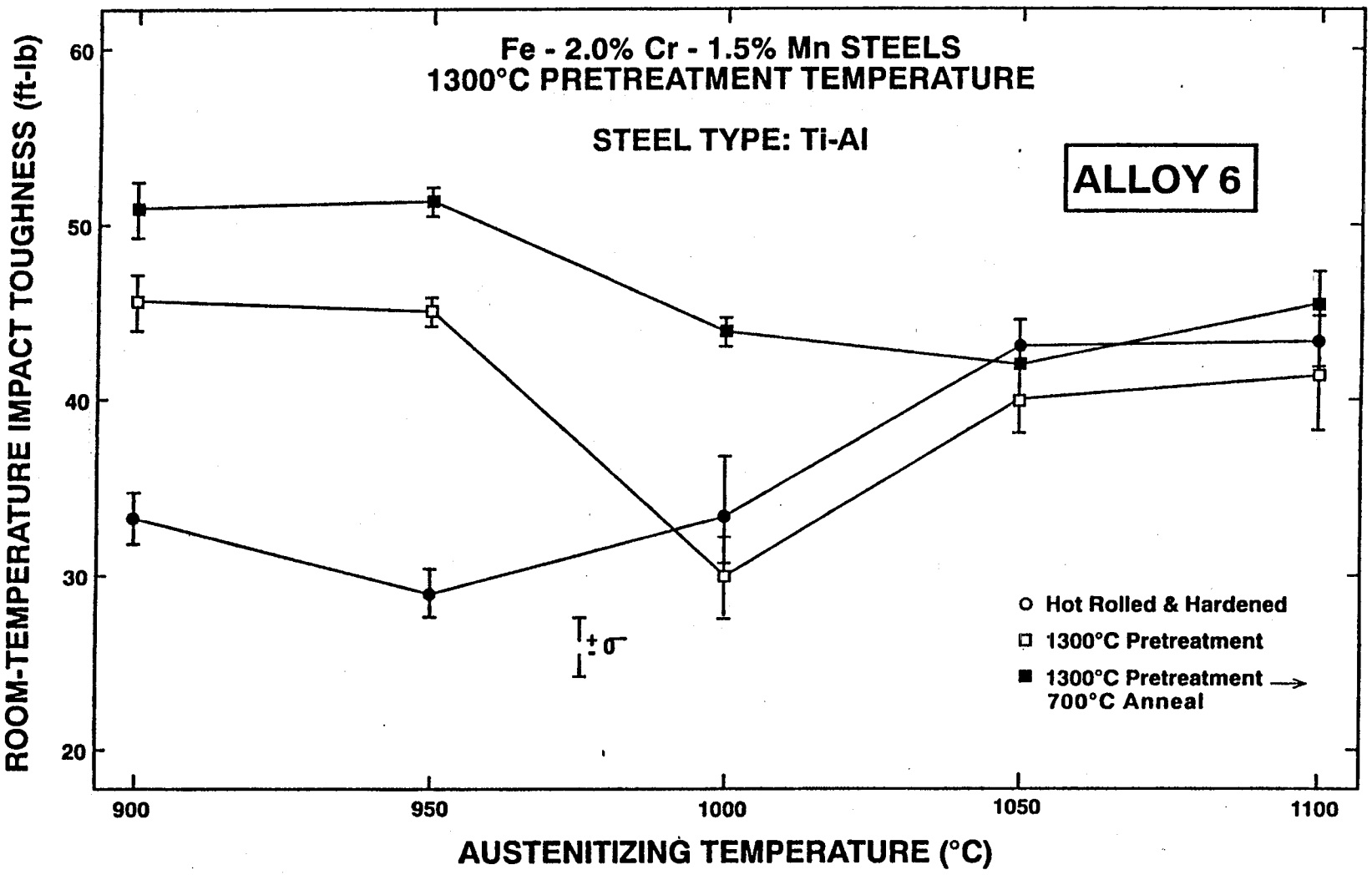
FIG. 6 is a graph similar to FIGS. 4–5 wherein Alloy 6 is subjected to a pretreatment temperature of 1300° C.

The room-temperature impact toughness is shown as a function of austenitizing temperature for the Ti—Al steel (Alloy 6) in Table 5 and FIGS. 4–6. All test specimens were water quenched after the pretreatment operation. Once again, the application of a high-temperature pretreatment operation is associated with an increase in the impact toughness of the steel, and the introduction of a subcritical anneal prior to final austenitization further improves the toughness. The impact toughness values for the hot-rolled and pretreated steels exhibit a similar dependence on austenitizing temperature, but the application of both a high-temperature (1200°–1300° C.) pretreatment operation and a subcritical anneal, e.g., 700° C., promotes the development of high levels of impact toughness after final austenitization at low to intermediate temperatures, see FIGS. 5 and 6. In the case of specimens pretreated at 1100° C. and annealed at 700° C., an increase in the final austenitization temperature from 900° C. to 1100° C. only produces a minor increase in the impact toughness of the hardened steel, see FIG. 4, which suggests that an insufficient amount of Ti(C,N) is taken into solution at 1100° C. to substantially decrease the effects of particle embrittlement after annealing and hardening. Finally, the impact toughness values for each pretreatment temperature tend to converge at high austenitizing temperatures (≧1050° C.), independent of prior processing history.

The Ti—Al steel composition of Alloy 6 exhibits a relatively low resistance to abnormal grain growth after pretreatment at 1100° C., although the incorporation of a subcritical anneal in the process significantly improves the grain coarsening resistance of the steel, i.e., the grain coarsening temperature increases to between 900° C. and 950° C. for the one hour austenitizing treatments. An increase in the pretreatment temperature to 1200° C. is associated with the development of a fine-grained microstructure after austenitization at 900° C., irrespective of whether an annealing treatment is included in the process; however, a subcritical anneal after pretreatment is required in order to maintain a fine-grained microstructure during final austenitization at 950° C. Finally, the application of a 1300° C. pretreatment, with or without a subsequent anneal, promotes the development and retention of a fine-grained microstructure during austenitization at 950° C.

Figure 7:
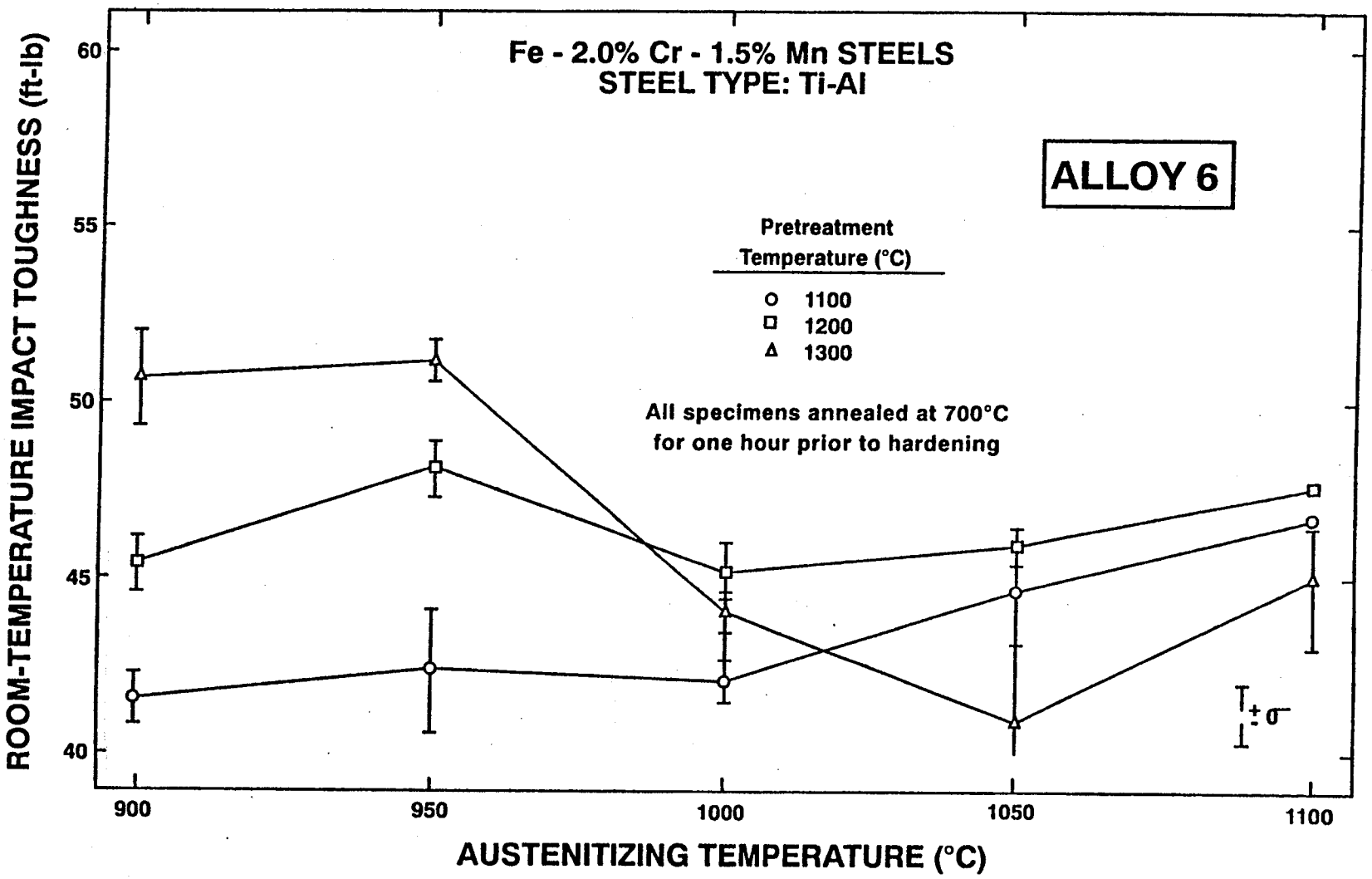
FIG. 7 depicts the room-temperature impact toughness of Alloy 6 as a function of pretreatment temperature and final austenitization temperature, wherein all specimens were subjected to a 700° C. subcritical anneal prior to final austenitization.

The effects of pretreatment temperature on the impact toughness of annealed and hardened specimens of the Ti—Al steel (Alloy 6) are shown in FIG. 7. An increase in pretreatment temperature from 1100° C. to 1300° C. is directly associated with an increase in the impact toughness from ≈42 ft-lb to ≈52 ft-lb after annealing and austenitization in the 900°–950° C. range, and the austenite microstructures produced by these heat treatments are uniformly fine grained in appearance. The general degradation in the impact toughness subsequent to austenitization at temperatures above 950° C. results from the formation of duplex austenite grain structures.

TABLE 5

Summary of Room-Temperature Impact Toughness Data for Alloy 6 (0.011% Ti, 0.033% Al, and 91 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 46 | 33.4 ± 1.1 |
| | | | 950 | 46 | 29.0 ± 1.7 |
| | | | 1000 | 45 | 33.8 ± 1.7 |
| | | | 1050 | 42 | 43.1 ± 1.3 |
| | | | 1100 | 40 | 43.6 ± 1.4 |
| 1100 | WQ | — | 900 | 44 | 38.5 ± 0.5 |
| | | | 950 | 45 | 37.0 ± 1.3 |
| | | | 1000 | 46 | 33.7 ± 2.9 |
| | | | 1050 | 45 | 44.5 ± 0.9 |
| | | | 1100 | 45 | 44.8 ± 0.8 |
| 1200 | WQ | — | 900 | — | 41.3 |
| | | | 950 | — | 36.2 ± 2.1 |
| | | | 1000 | — | 34.3 ± 2.1 |
| | | | 1050 | — | 42.7 ± 2.5 |
| | | | 1100 | — | 49.5 ± 1.8 |
| 1300 | WQ | — | 900 | 46 | 45.7 ± 1.5 |
| | | | 950 | 46 | 45.0 ± 0.9 |
| | | | 1000 | 45 | 30.0 ± 2.4 |
| | | | 1050 | 44 | 40.3 ± 2.1 |
| | | | 1100 | 45 | 41.7 ± 3.8 |
| 1100 | WQ | 700 | 900 | 46 | 41.8 ± 0.8 |
| | | | 950 | 46 | 42.5 ± 1.8 |
| | | | 1000 | 46 | 42.2 ± 0.3 |
| | | | 1050 | 45 | 44.7 ± 1.5 |
| | | | 1100 | 45 | 46.8 |
| 1200 | WQ | 700 | 900 | 46 | 45.5 ± 0.9 |
| | | | 950 | 46 | 48.3 ± 1.5 |
| | | | 1000 | 45 | 45.3 ± 0.8 |
| | | | 1050 | 46 | 46.0 ± 0.5 |
| | | | 1100 | 45 | 47.5 |
| 1300 | WQ | 700 | 900 | 46 | 50.8 ± 1.3 |
| | | | 950 | 46 | 51.3 ± 0.6 |
| | | | 1000 | 45 | 44.2 ± 0.8 |
| | | | 1050 | 45 | 41.0 ± 2.2 |
| | | | 1100 | 45 | 45.0 ± 1.5 |

Application of the Process to the Nb—Al Steel

Figure 8:
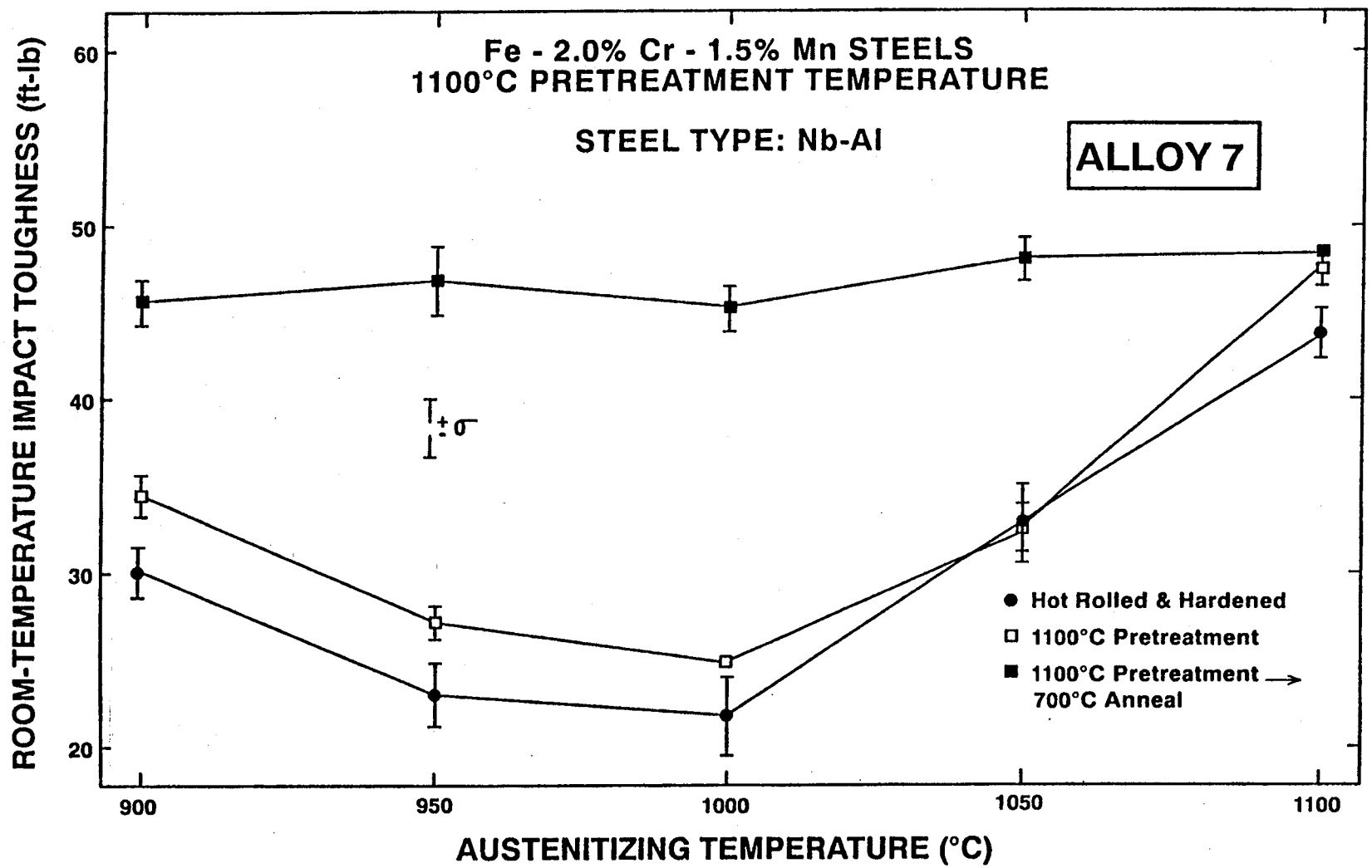
FIG. 8 is a graph similar to FIG. 4 depicting the impact properties of Alloy 7 pretreated at 1100° C.
Figure 9:
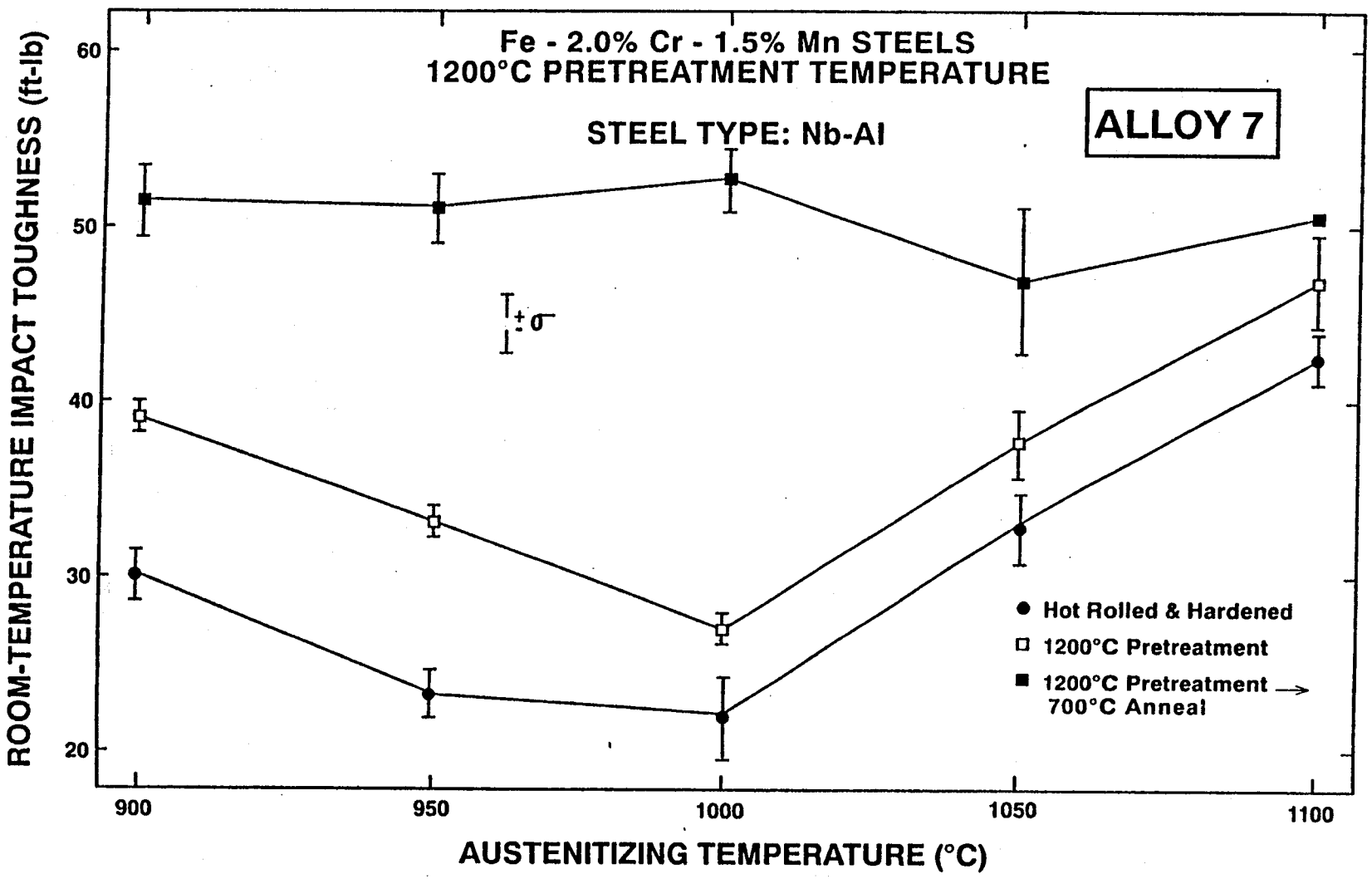
FIG. 9 is a graph similar to FIG. 8 wherein Alloy 7 is subjected to a pretreatment temperature of 1200° C.
Figure 10:
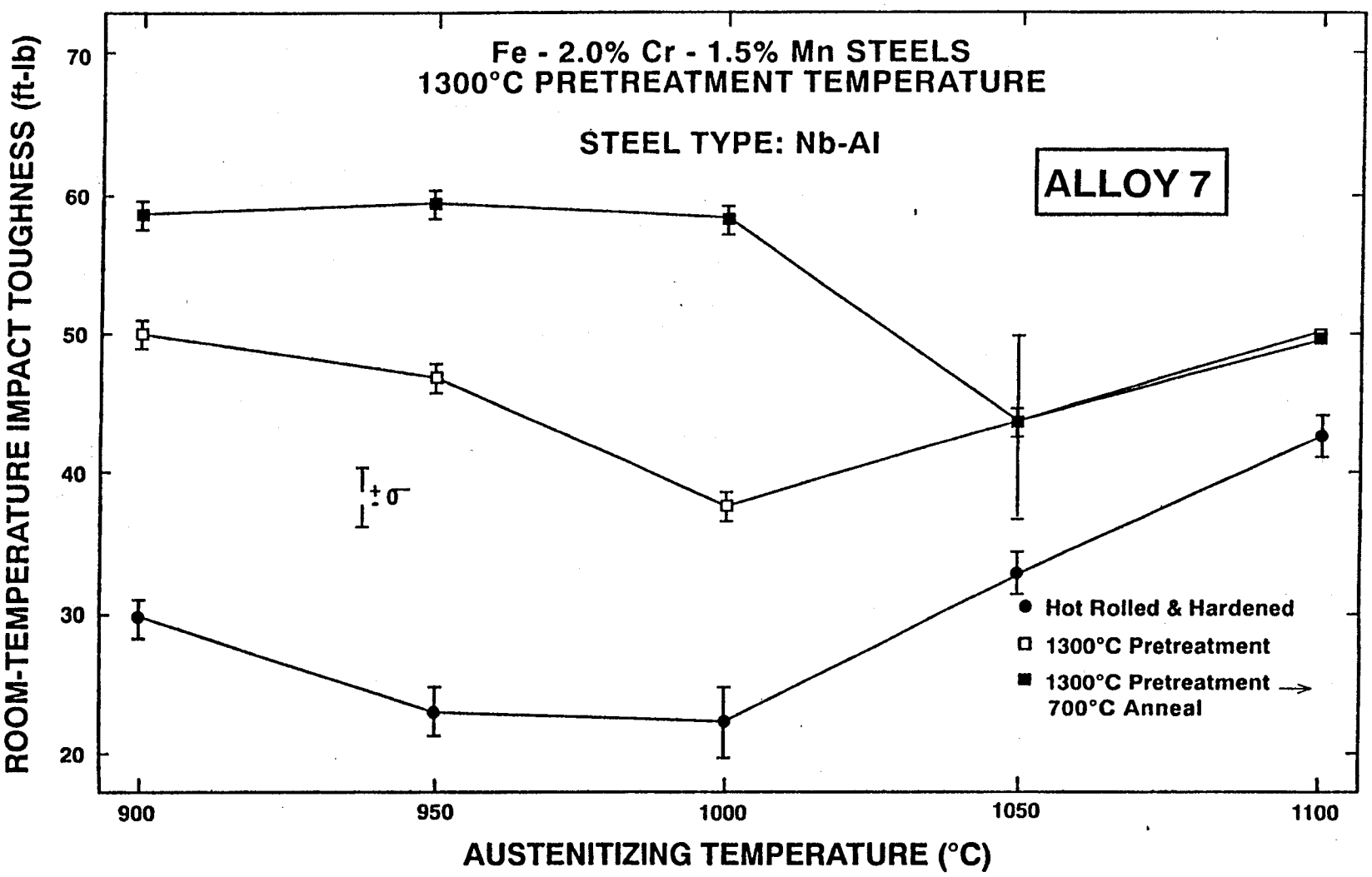
FIG. 10 is a graph similar to FIGS. 8–9 wherein Alloy 7 is subjected to a pretreatment temperature of 1300° C.

The room-temperature impact toughness of the Nb—Al steel (Alloy 7) is shown as a function of austenitizing temperature in Table 6 and FIGS. 8–10. All test specimens were water quenched after the pretreatment operation. In general, the variation in the toughness of the hot-rolled and pretreated materials with austenitizing temperature is equivalent to the trends observed with the Ti—Nb—Al (Alloys 1–4) and Ti—Al (Alloy 6) steels; that is, the impact toughness of the pretreated specimens tends to follow the trend exhibited by the hot-rolled and hardened material, but the application of the high-temperature pretreatment and subcritical annealing operations provides high levels of impact toughness after austenitization in the 900°–1000° C. range.

The Nb—Al steel (Alloy 7) exhibits a higher resistance to grain coarsening than the Ti—Al steel (Alloy 6) after an 1100° C. pretreatment. It is also evident that the application of a subcritical anneal improves the grain coarsening resistance of the Nb—Al steel after pretreatment at relatively low temperatures. The Nb—Al steel is predominantly fine grained subsequent to pretreatment at temperatures above 1200° C., although there are moderately frequent occurrences of larger grains with an unusual appearance. These larger grains appear to form on remnants of the austenite grain boundary/precipitate structure formed during the high-temperature pretreatment operation, and observations of these regions suggest that microstructural evolution occurs by the nucleation and growth of a high density of small grains in the vicinity of the remnant boundary followed by the coarsening and coalescence of the transformed microstructure into a low density of elongated grains on each side of the remnant boundary. Solute drag effects, produced by the dissolution of Nb(C,N) during the pretreatment, may be responsible for the general appearance of the grains in the vicinity of the remnant boundaries, i.e., curved outer boundaries with an absence of well defined points of pinning by precipitates. Nevertheless, the application of a high-temperature (1200°-1300° C.) pretreatment and a subcritical anneal promotes the development of uniformly fine grained microstructures during final austenitization at temperatures in the 900°-1000° C. range.

Figure 11:
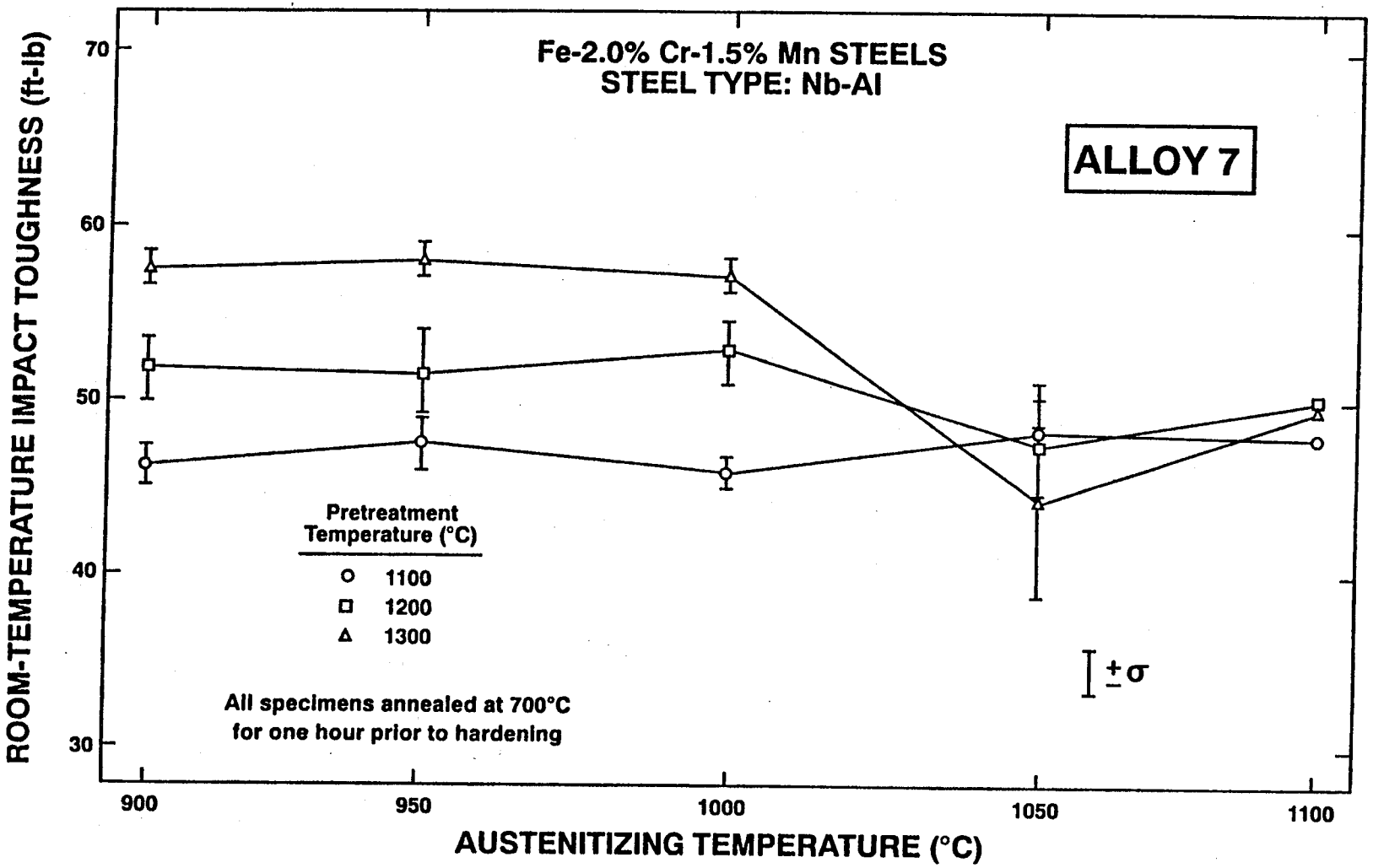
FIG. 11 is a graph similar to FIG. 7 depicting the impact properties of Alloy 7 as a function of pretreatment temperatures of 1100° C., 1200° C., and 1300° C. wherein all specimens received a subcritical anneal.

The effects of pretreatment temperature on the impact toughness of annealed and hardened specimens of the Nb—Al steel (Alloy 7) are summarized in FIG. 11. The dependence of the impact toughness on both the pretreatment and austenitizing temperatures is equivalent to that exhibited by both the Ti—Al and Nb—Al steels, although the increase in toughness produced by a 200° C. increase in pretreatment temperature is somewhat larger in the Nb—Al steel after austenitization in the 900°-1000° C. range. Once again, high levels of impact toughness in the Nb—Al steel are generally associated with the development of a fine grained microstructure during final austenitization of the pretreated and annealed material, and the degradation in impact toughness after austenitization at temperatures above 1000° C. is related to the formation of duplex grain structures.

TABLE 6

Summary of Room-Temperature Impact Toughness Data for Alloy 7 (0.014% Nb, 0.027% Al, and 91 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 46 | 30.4 ± 1.5 |
| | | | 950 | 46 | 23.4 ± 1.6 |
| | | | 1000 | 45 | 22.0 ± 2.3 |
| | | | 1050 | 43 | 33.0 ± 2.1 |
| | | | 1100 | 41 | 42.5 ± 1.2 |
| 1100 | WQ | — | 900 | 46 | 34.7 ± 0.6 |
| | | | 950 | 47 | 27.4 ± 0.3 |
| | | | 1000 | 45 | 24.8 |
| | | | 1050 | 45 | 32.5 ± 1.3 |
| | | | 1100 | 45 | 46.5 |
| 1200 | WQ | — | 900 | 46 | 38.5 ± 1.3 |
| | | | 950 | 46 | 33.3 ± 0.6 |
| | | | 1000 | 45 | 27.3 ± 0.4 |
| | | | 1050 | 45 | 37.8 ± 1.5 |
| | | | 1100 | 44 | 47.0 |
| 1300 | WQ | — | 900 | 46 | 49.8 ± 0.8 |
| | | | 950 | 45 | 46.5 ± 0.5 |
| | | | 1000 | 46 | 37.7 ± 1.3 |
| | | | 1050 | 45 | 43.3 ± 1.4 |
| | | | 1100 | 44 | 50.0 |
| 1100 | WQ | 700 | 900 | 46 | 45.7 ± 1.3 |
| | | | 950 | 46 | 46.8 ± 2.0 |
| | | | 1000 | 45 | 45.0 ± 1.0 |
| | | | 1050 | 45 | 47.8 ± 1.0 |
| | | | 1100 | 44 | 47.8 |
| 1200 | WQ | 700 | 900 | 45 | 51.7 ± 2.1 |
| | | | 950 | 45 | 51.3 ± 2.8 |
| | | | 1000 | 45 | 52.8 ± 1.6 |
| | | | 1050 | 44 | 46.7 ± 4.2 |
| | | | 1100 | — | 50.8 |
| 1300 | WQ | 700 | 900 | 46 | 58.2 ± 1.0 |
| | | | 950 | 46 | 59.0 ± 0.5 |
| | | | 1000 | 45 | 57.8 ± 0.6 |
| | | | 1050 | 45 | 43.3 ± 1.4 |
| | | | 1100 | 44 | 49.5 |

Application of the Process to the Al Steels

Figure 12:
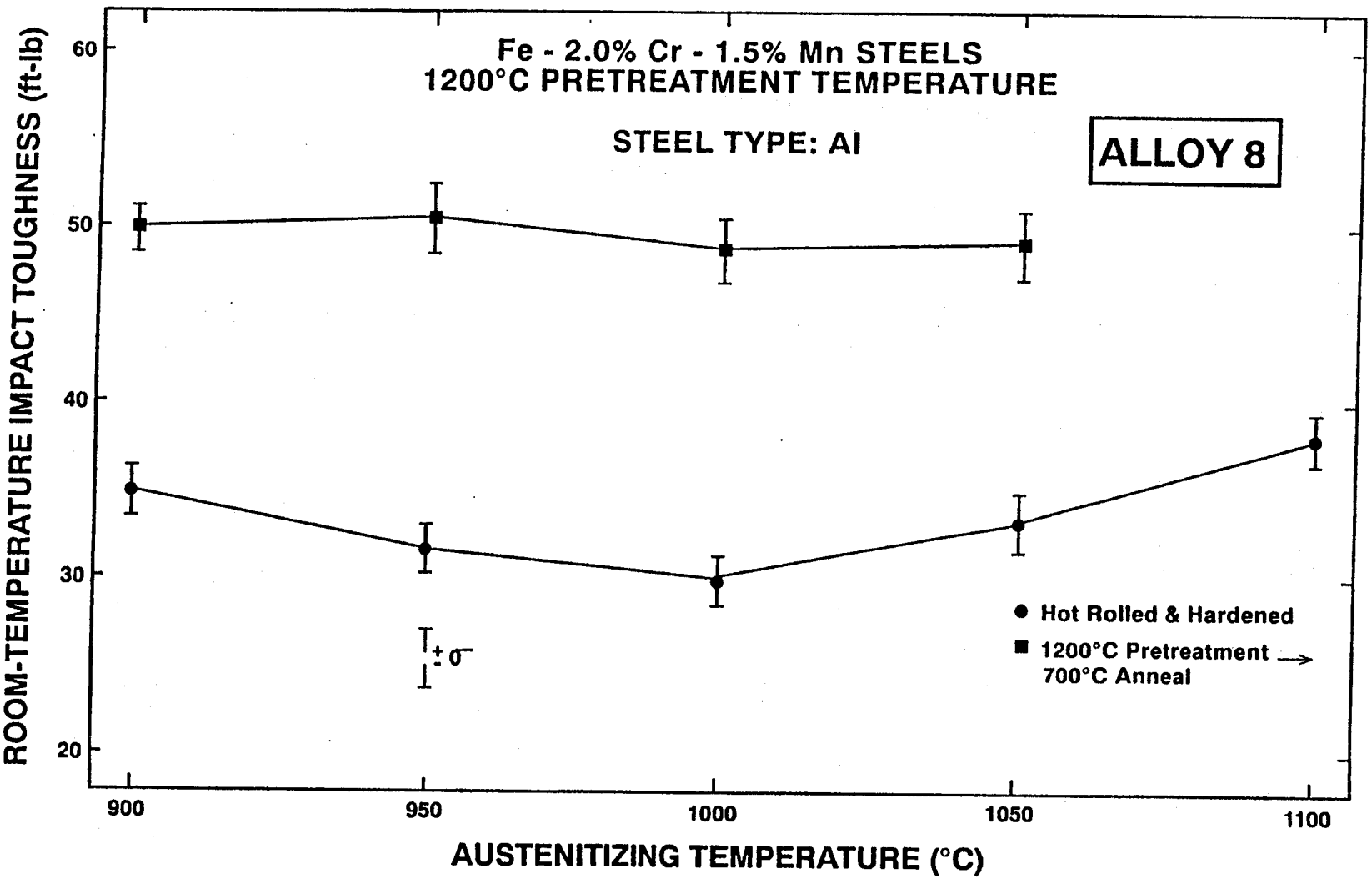
FIG. 12 depicts the room-temperature impact toughness of Alloy 8 comparing hot-rolled and hardened specimens with specimens pretreated at 1200° C and subcritically annealed as a function of final austenitizing temperature.
Figure 13:
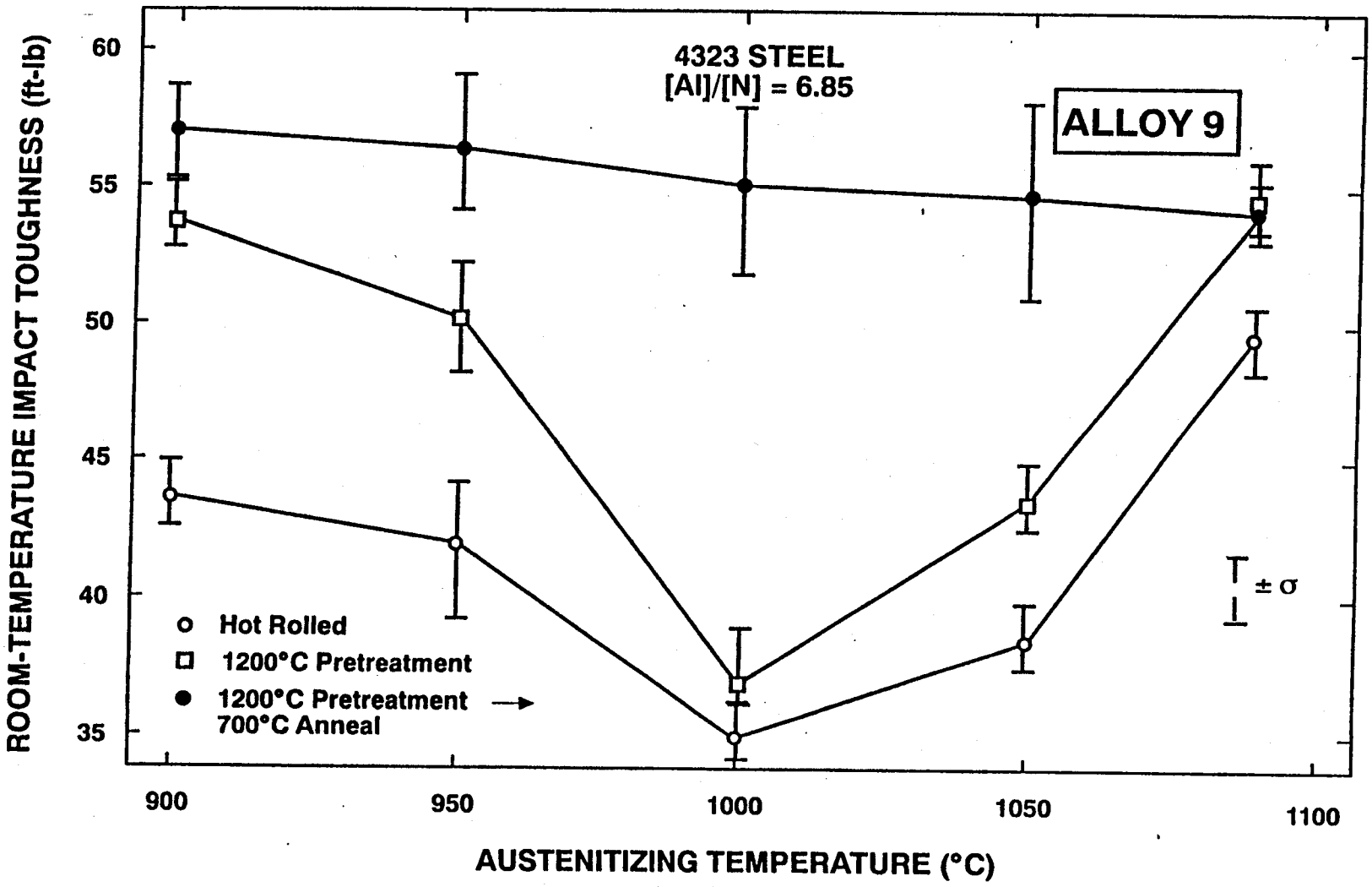
FIG. 13 is a graph similar to FIG. 12 for Alloy 9 wherein an additional set of specimens were pretreated at 1200° C. with no subcritical anneal prior to final austenitization.

The room-temperature impact toughness of the Al steels (Alloys 8 and 9) is shown as a function of austenitizing temperature in Tables 7 and 8 and FIGS. 12-13. All test specimens were water quenched after the pretreatment operation. The application of a high-temperature pretreatment and a subcritical anneal is once again associated with the development of high levels of impact toughness after austenitization at low to intermediate temperatures, and for this class of steels, which contain aluminum as the only grain-refining element, it appears that a high level of impact toughness develops after austenitization at any temperature in the 900°-1100° C. range. In addition, the omission of a subcritical anneal at 700° C. prior to final austenitization increases the sensitivity of the material to the effects of particle embrittlement, as evidenced by the strong dependence of impact toughness on austenitizing temperature in Alloy 9, FIG. 13.

In comparing these two hot-rolled and hardened steels in FIGS. 12 and 13, the impact toughness of Alloy 9 exhibits a much stronger dependence on austenitizing temperature than Alloy 8. Since aluminum is the only grain refining element in these two steels, it is reasonable to consider these toughness data in terms of the [Al] to [N] ratio for each steel. Specifically, Alloy 8, which exhibits a relatively weak dependence of impact toughness on austenitizing temperature, possesses an effective [Al]/[N] ratio close to the stoichiometric ratio of 1.9, whereas the extremely hyperstoichiometric ratio of [Al] to [N] in Alloy 9, i.e., $[Al_{eff}]/[N]=5.4$, correlates with the strong variation between impact toughness and austenitizing temperature, FIG. 13. The value of $[Al_{eff}]$ is evaluated from the expression: $[Al_{eff}]=[Al^t]-2.53[O^t]$ where $[Al^t]$ and $[O^t]$ are the total aluminum and oxygen contents of the steel, respectively. It would not be unreasonable to speculate that the high potential for precipitate coarsening in a hot-rolled steel with a hyperstoichiometric [Al]/[N] ratio could be manifested as a degradation in the impact toughness of the hardened steel via the direct effects of particle embrittlement and the indirect effects of abnormal grain coarsening during austenitization.

TABLE 7

Summary of Room-Temperature Impact Toughness Data for Alloy 8 (0.025% Al and 86 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 46 | 35.0 ± 1.2 |
| | | | 950 | 45 | 31.7 ± 1.3 |
| | | | 1000 | 45 | 29.9 ± 1.4 |
| | | | 1050 | 43 | 33.4 ± 1.8 |
| | | | 1100 | 41 | 38.3 ± 1.4 |
| 1200 | WQ | 700 | 900 | 46 | 49.4 ± 1.9 |
| | | | 950 | 46 | 50.1 ± 2.7 |
| | | | 1000 | 45 | 48.4 ± 1.7 |
| | | | 1050 | 45 | 48.8 ± 1.8 |

TABLE 8

Summary of Room-Temperature Impact Toughness Data for Alloy 9 (0.037% Al and 54 ppm N)

| Pretreatment Temperature (°C.) | Cooling Condition | Annealing Temperature (°C.) | Austenitizing Temperature (°C.) | Rockwell C Hardness | Average Impact Energy (ft-lb) |
|---|---|---|---|---|---|
| — | — | — | 900 | 45 | 43.6 ± 1.2 |
| | | | 950 | 45 | 41.9 ± 2.3 |
| | | | 1000 | 44 | 34.8 ± 0.8 |
| | | | 1050 | 44 | 38.7 ± 1.1 |
| | | | 1100 | 43 | 49.7 ± 0.3 |
| 1200 | WQ | — | 900 | 45 | 54.1 ± 1.2 |
| | | | 950 | 45 | 50.4 ± 1.9 |
| | | | 1000 | 44 | 36.6 ± 1.7 |
| | | | 1050 | 44 | 43.5 ± 1.3 |
| | | | 1100 | 44 | 54.6 ± 1.3 |
| 1200 | WQ | 700 | 900 | 45 | 57.0 ± 1.5 |
| | | | 950 | 45 | 56.6 ± 2.3 |
| | | | 1000 | 44 | 55.2 ± 3.1 |
| | | | 1050 | 44 | 54.8 ± 3.4 |
| | | | 1100 | 44 | 54.3 ± 0.8 |

Figure 14:
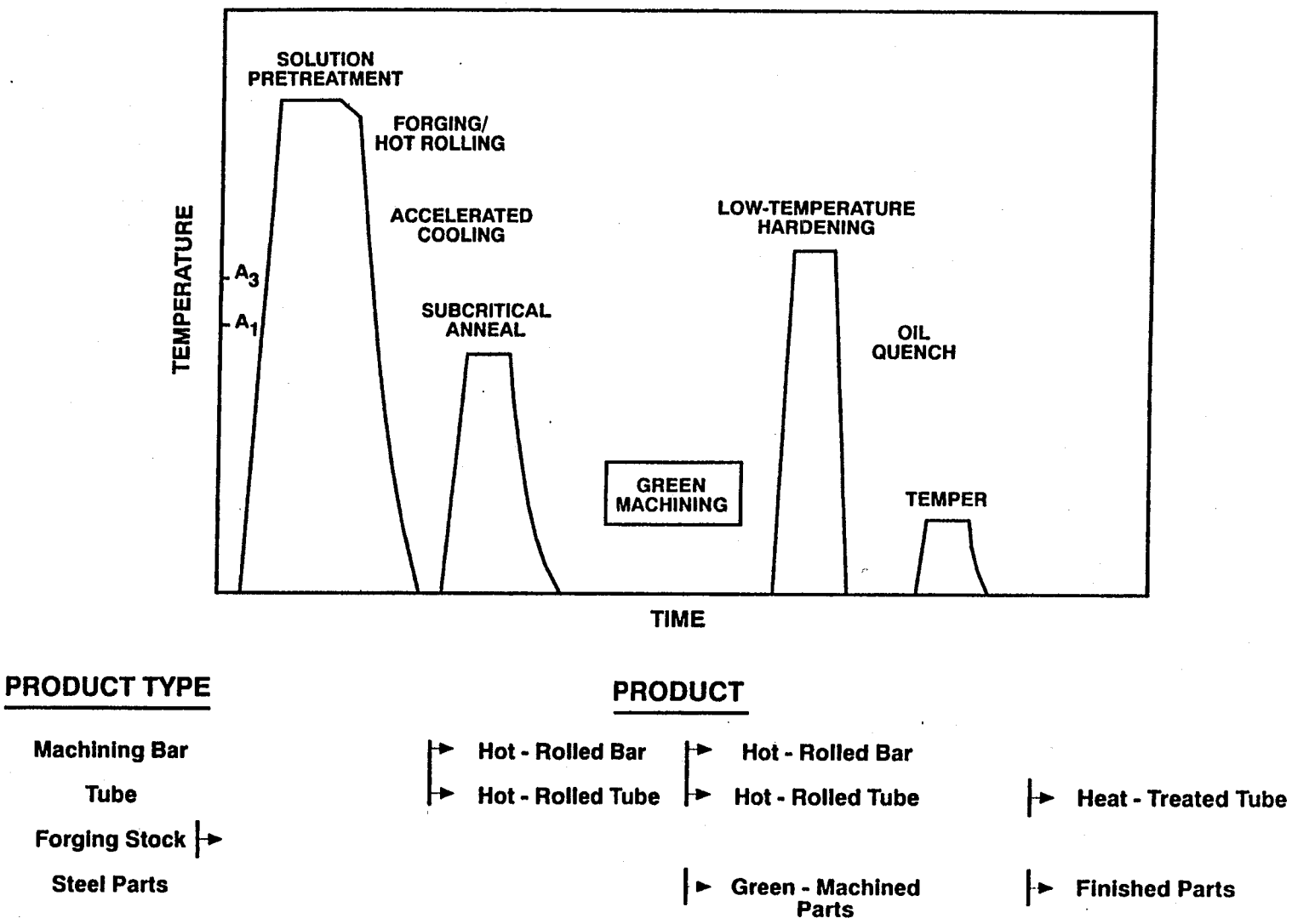
FIG. 14 is a schematic drawing of a preferred heat treatment method according to the invention also depicting various types of product which may be made in accordance therewith.

Practical Applicability of the Thermal/Thermomechanical Process of the Invention The thermal/thermomechanical process of the present invention is particularly useful in the production of killed alloy steel bars, tubes and forged products containing grain-refining additions such as Al, Ti, Nb, and V, either singly or in combination. A schematic illustration of various ways of incorporating the process in the manufacture of these products is set forth in FIG. 14. The production of hot-rolled machining bars and tubes may be accomplished via high-temperature reheating, hot rolling or piercing and accelerated cooling. These products may be distributed to customers that employ a subcritical anneal prior to machining and hardening, or alternatively, the material may be subcritically annealed after hot working for customers that require a low-hardness, relatively machinable material. The process could be further employed in the manufacture of heat-treated tubes and either rough machined or finished components for the production of specific parts. In the context of manufacturing hot-rolled bars and tubes, the high-temperature pretreatment portion of the process closely resembles a conventional hot-working operation; that is, the high-temperature pretreatment is incorporated as an integral part of the final reheating and hot-working operations in order to avoid the effects of particle embrittlement in the final product.

The process may have the greatest potential applicability in the manufacture of forged products, where in contrast to the production of bars and tubes, the high-temperature pretreatment is applied to a hot-rolled steel in the production of forged components. High-temperature reheating and forging generally provide the most viable method of processing in terms of maintaining forgeability and die life, although it must be emphasized that the ultimate objective of the high-temperature pretreatment is to decrease the volume fraction of coarse carbonitride precipitates in the steel. Subsequent to forging, the material must be cooled at an accelerated rate to below the $\gamma$ to $\alpha$ transformation in order to limit the extent of microalloy carbonitride and/or AlN precipitation in austenite. High-temperature forging followed by accelerated cooling has been most widely applied to vanadium-modified, medium-carbon steels, and in an effort to utilize this technology, an increasing number of commercial forgers have installed conveyor lines with forced-air cooling capabilities. Some forgers currently have the capability to direct quench parts off the forging press into water or oil, but this method of production is mostly limited to relatively small parts with simple shapes. This general technology, which has proved effective in the production of forged components from vanadium microalloyed steels, comprises the initial portion of the current process, and in conjunction with subcritical annealing and hardening at conventional temperatures (850°–950° C.), the process provides a grain-refined, high-strength steel with good toughness.

Figure 15A:
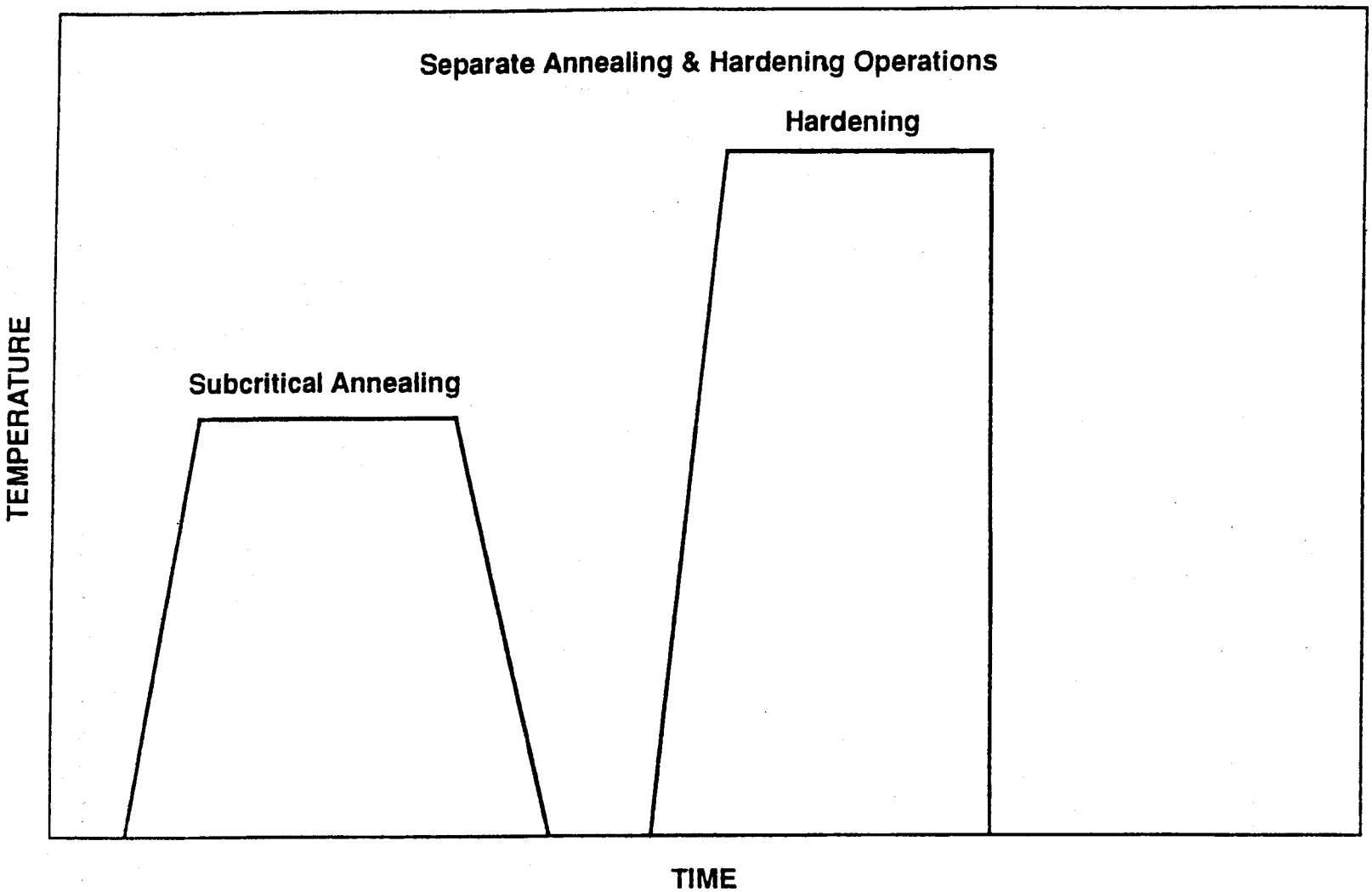
FIG. 15 is a schematic drawing showing several preferred methods of carrying out the subcritical annealing and final austenitization steps of the invention.
Figure 15B:
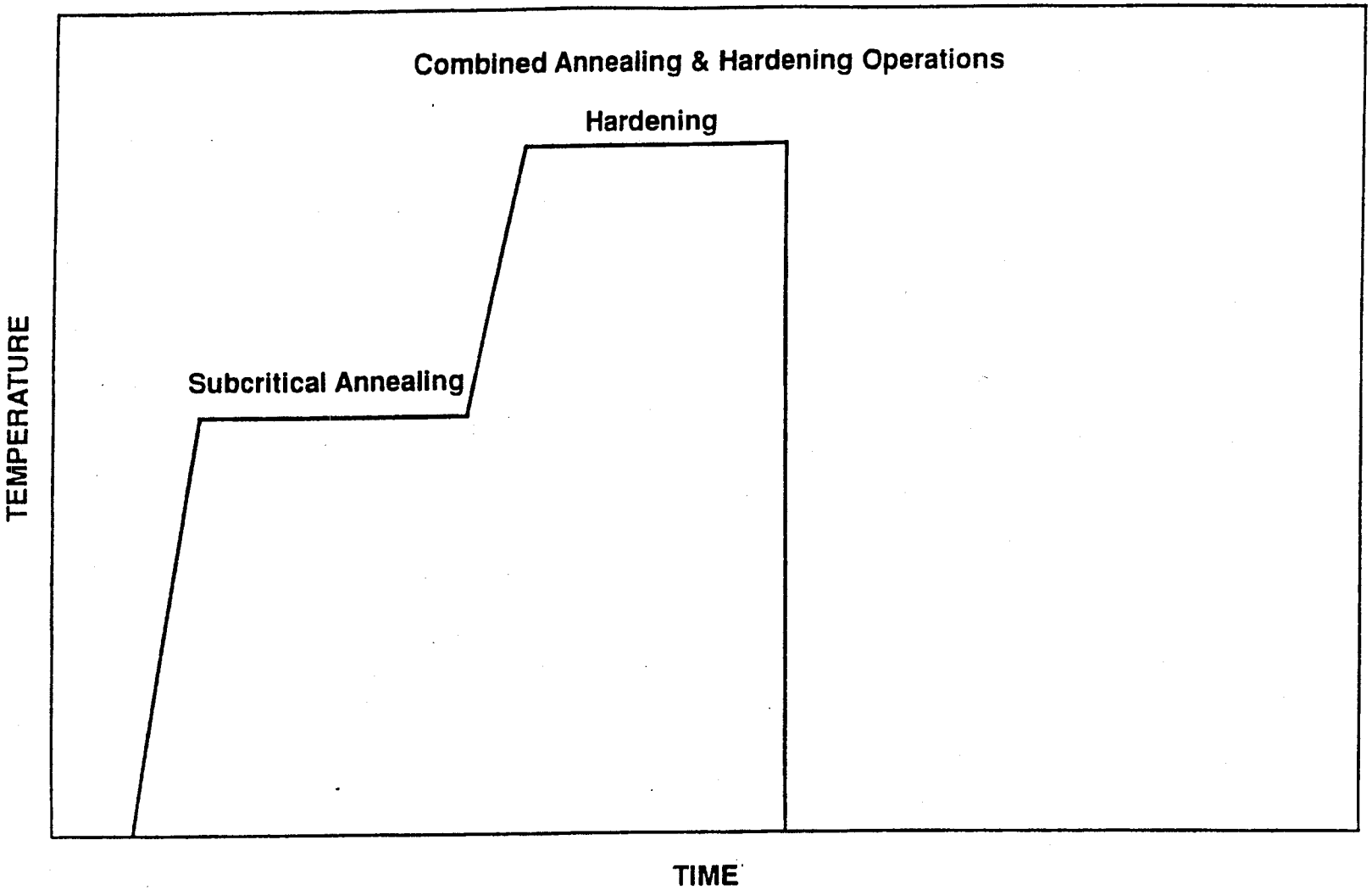
Figure 15C:
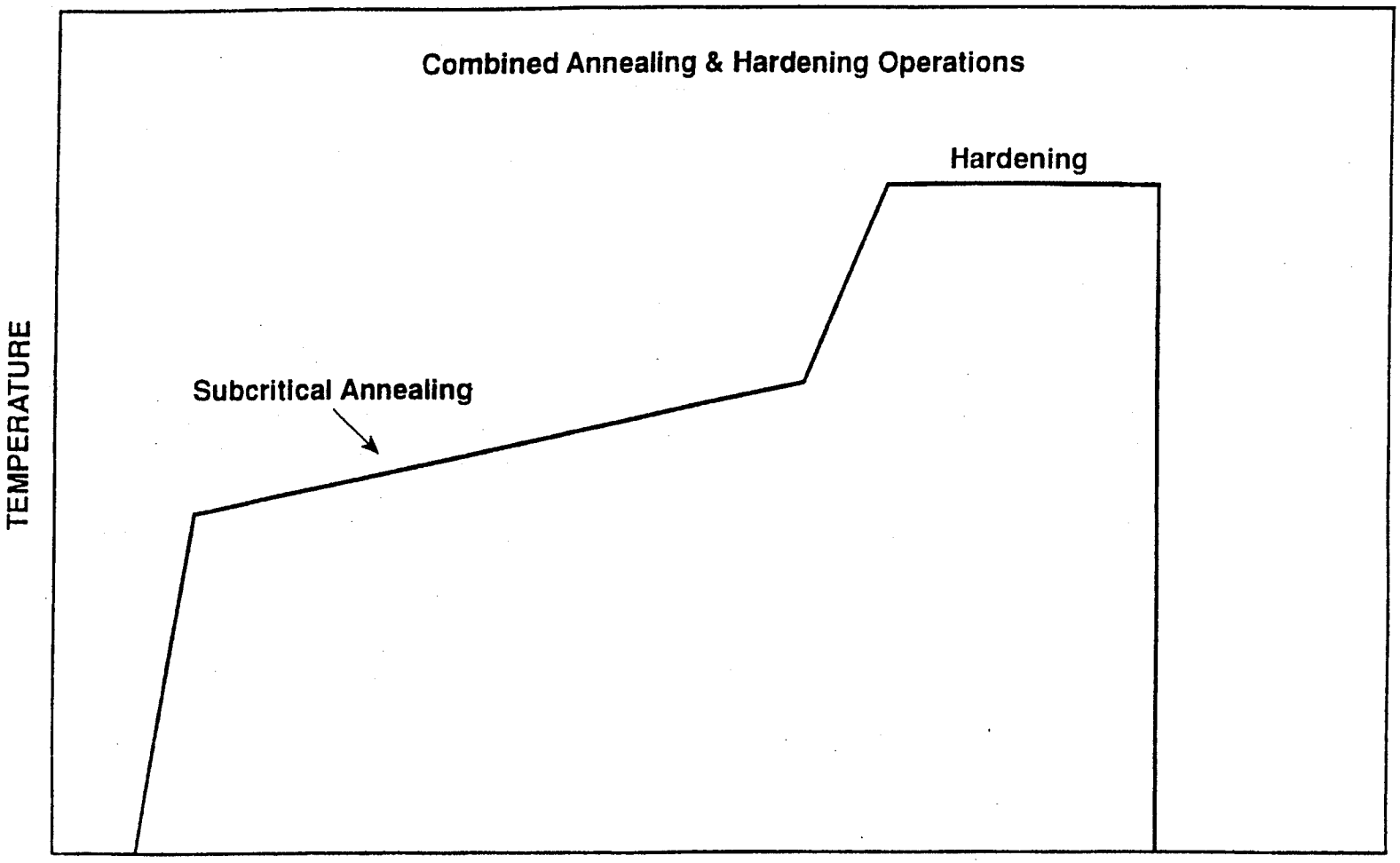

The application of the annealing and hardening operations may be conducted in several manners. Annealing and hardening can be conducted as separate operations in cases where a component requires machining before the final hardening step, see FIG. 15*a*, or if a multiple-chamber or multi-zone furnace is utilized for the last two steps of the process, components can be isothermally annealed and austenitized, as in FIG. 15*b*. Alternatively, the furnace temperature could be slowly increased through the $\alpha$ to $\gamma$ transformation, see FIG. 15*c*. This latter type of treatment may be completed in a single-zone furnace by charging the components at the annealing temperature, allowing the furnace load to reach the annealing temperature, and ramping the temperature at a slow rate through the $\alpha$ to $\gamma$ transformation. Ramped annealing treatments prior to final austenitization have been shown to provide an equivalent degree of grain coarsening resistance as isothermal annealing treatments in high-nitrogen steels containing niobium and aluminum, provided that the heating rate is maintained below some critical value. In effect, heating at slow rates through the $\alpha$ to $\gamma$ transformation allows a sufficient content of AlN and carbide-rich carbonitrides to precipitate in ferrite, thereby providing a high degree of grain coarsening resistance during subsequent austenitization.

In addition to providing a fine austenite grain size while minimizing the effects of particle embrittlement on the toughness of grain-refined, high-strength steels, the process of the present invention has several additional advantages. First, reheating and deformation at high temperatures helps to homogenize the material, and this type of treatment provides a particularly attractive method of processing in older mills and forge shops where mill/press capacity and plant layout limit the potential of applying any type of controlled processing, e.g., recrystallization rolling/forging and controlled rolling. Second, the application of a subcritical anneal, which is included in the process as a means of forcing AlN and microalloy carbonitride precipitation in ferrite, has the obvious benefit of enhancing the machinability and cold formability of the material. Finally, in contrast to the high-temperature hardening treatments typically used to improve the impact toughness of this class of steels, the ability of the process to minimize/alleviate the effects of particle embrittlement after final austenitization at conventional temperatures helps to minimize distortion and the development of deleterious residual stresses during quenching.

The above-described tests demonstrate that the thermal/thermomechanical process of the present invention provides a uniformly fine-grained microstructure during austenitization while minimizing the deleterious effects of particle embrittlement on the toughness of the resultant microstructure. The process comprises five basic operations (i) pretreatment involving reheating and hot deformation at temperatures, e.g., 1300° C., approaching the solution temperature of the least soluble nitride or carbonitride species in the steel; (ii) accelerated cooling, preferably by quenching in a suitable medium, after hot deformation in order to suppress the nucleation and growth of precipitates in austenite; (iii) subcritical annealing, e.g., 700° C., that promotes the development of a dense dispersion of fine carbonitride and AlN precipitates in ferrite; (iv) austenitization (hardening) at conventional temperatures, e.g., 850°–950° C.; and (v) tempering at a temperature below the subcritical annealing temperature of step (iii). The process of the invention is applicable to high-strength steels containing grain-refining elements such as Al, Ti, Nb, and V, although the process will provide an optimum combination of grain coarsening resistance and impact toughness when applied to steels containing aluminum or aluminum in conjunction with any combination of up to two microalloying elements selected from the group consisting of Ti, Nb, and V. Accordingly, the process of the invention is particularly applicable to high-strength steels containing multiple grain-refining elements as a consequence of restricted carbonitride solubility at carbon contents above about 0.2%.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A process for improving the impact properties of a grain-refined, high-strength steel comprising the steps of:

(a) pretreating the steel by heating and hot deformation at temperatures at least approximating a solution temperature of a least soluble nitride or carbonitride species present in the steel;
(b) cooling the pretreated steel at an accelerated rate;
(c) subcritical annealing;
(d) austenitizing;
(e) quenching; and
(f) tempering at a temperature below a subcritical annealing temperature in step (c).

2. The process of claim 1 wherein the pretreating step is conducted at a temperature of about 1200° C.

3. The process of claim 1 wherein the pretreating step is conducted at a temperature of about 1300° C.

4. The process of claim 1 wherein the accelerated cooling step immediately following the pretreating step is one selected from the group consisting of water quenching, oil quenching and forced-air cooling to room temperature.

5. The process of claim 1 wherein the austenitizing step is conducted by heating between about 850°–950° C.

6. The process of claim 1 wherein the tempering step is conducted at a temperature of about 250° C.

7. The process of claim 1 wherein the high-strength steel contains about 1.5 wt. % Mn, about 2.0 wt. % Cr and about 0.10–0.40 wt. % C, and wherein the steel contains at least one grain-refining element selected from the group consisting of up to about 0.05 wt. % Al, up to about 0.04 wt. % Ti, up to about 0.08 wt. % Nb, and up to about 0.15 wt. % V.

8. The process of claim 7 wherein the grain-refining element is Al.

9. The process of claim 7 wherein the grain-refining element is Ti.

10. The process of claim 7 wherein the grain-refining element is Nb.

11. The process of claim 7 wherein the grain-refining element is V.

12. The process of claim 7 wherein the steel contains Al and Ti as the grain-refining elements.

13. The process of claim 7 wherein the steel contains Al and Nb as the grain-refining elements.

14. The process of claim 7 wherein the steel contains Al and V as the grain-refining elements.

15. The process of claim 7 wherein the steel contains Nb and V as the grain-refining elements.

16. The process of claim 7 wherein the steel contains Ti and Nb as grain-refining elements.

17. The process of claim 7 wherein the steel contains Ti and V as the grain-refining elements.

18. The process of claim 7 wherein the steel contains Al, Ti and Nb as the grain-refining elements.

19. The process of claim 7 wherein the steel contains Al, Nb and V as the grain-refining elements.

20. The process of claim 7 wherein the steel contains Al, Ti and V as the grain-refining elements.

21. The process of claim 1 wherein the high-strength steel is an aluminum-killed type 4323 steel.

22. A process for improving the impact properties of a high-strength steel of the type containing about 1.5 wt. % Mn, about 2.0 wt. % Cr, about 0.10–0.40 wt. % C and an effective amount of at least one or more grain-refining elements selected from the group consisting of Al, Ti, Nb, and V to provide a fine-grained microstructure, said process comprising:

(a) pretreating the steel by heating and hot deformation at a temperature in excess of about 1200° C.;
(b) cooling the pretreated steel at an accelerated rate to about room temperature;
(c) subcritical annealing at a temperature of about 700° C.;
(d) austenitizing at a temperature of between about 850°–950° C. to avoid the formation of a duplexed grain structure;
(e) quenching; and
(f) tempering.

23. The process of claim 22 wherein the subcritical annealing and austenitizing steps are conducted in a single-zone furnace comprising the steps of:

(a) charging the steel into said furnace at a furnace temperature of about 700° C.;
(b) heating the steel to the 700° C. temperature; and
(c) ramping the furnace temperature at a slow rate through the $\alpha$ to $\gamma$ transformation for said steel to reach a hardening temperature of between about 850°–950° C.

24. A steel article produced in accordance with claim 22.

25. A process for improving the impact properties of a high-strength steel of the type containing about 1.5 wt. % Mn, about 2.0 wt. % Cr, about 0.10°–0.40 wt. % C and effective amounts of Ti, Nb and Al as grain-refining elements to provide a fine-grained microstructure, said process comprising:

(a) pretreating the steel by heating and hot deformation at a temperature in excess of about 1200° C.;
(b) cooling the pretreated steel at an accelerated rate to about room temperature;
(c) subcritical annealing at a temperature of about 700° C.;
(d) austenitizing at a temperature of between about 850°–950° C.;
(e) quenching; and
(f) tempering.

26. A process for improving the impact properties of a high-strength steel of the type containing about 1.5 wt. % Mn, about 2.0 wt. % Cr, about 0.10–0.40 wt. % C and effective amounts of Ti and Al as grain-refining elements to provide a fine-grained microstructure, said process comprising:

(a) pretreating the steel by heating and hot deformation at a temperature in excess of about 1200° C.;
(b) cooling the pretreated steel at an accelerated rate to about room temperature;
(c) subcritical annealing at a temperature of about 700° C.;
(d) austenitizing at a temperature of between about 850°–950° C.;
(e) quenching; and
(f) tempering.

27. A process for improving the impact properties of a high-strength steel of the type containing about 1.5 wt. % Mn, about 2.0 wt. % Cr, about 0.10–0.40 wt. % C and effective amounts of Nb and Al as grain-refining elements to provide a fine-grained microstructure, said process comprising:

(a) pretreating the steel by heating and hot deformation at a temperature in excess of about 1200° C.;
(b) cooling the pretreated steel at an accelerated rate to about room temperature;
(c) subcritical annealing at a temperature of about 700° C;
(d) austenitizing at a temperature of between about 850°–950° C.;
(e) quenching; and
(f) tempering.

28. A process for improving the impact properties of a high-strength steel of the type containing about 1.5 wt. % Mn, about 2.0 wt. % Cr, about 0.10–0.40 wt. % C and an effective amount of Al as a grain-refining element to provide a fine-grained microstructure, said process comprising:

(a) pretreating the steel by heating and hot deformation at a temperature of about 1200° C.;
(b) cooling the pretreated steel at an accelerated rate to about room temperature;
(c) subcritical annealing at a temperature of about 700° C.;
(d) austenitizing at a temperature of between about 850°–950° C.;
(e) quenching; and
(f) tempering.

29. A process for improving the impact properties of an aluminum-killed 4323 grade of steel having a fine-grained microstructure comprising:

(a) pretreating the steel by heating and hot deformation at a temperature of about 1200° C.;
(b) cooling the pretreated steel at an accelerated rate to about room temperature;
(c) subcritical annealing at a temperature of about 700° C.;
(d) austenitizing at a temperature of between about 850°–950° C. to avoid the formation of a duplexed grain structure;

(e) quenching; and (f) tempering.

30. An article produced in accordance with the process of claim 29.

31. A high-strength steel article having improved impact properties comprising an effective amount of one or more grain-refining elements selected from the group consisting of Al, Ti, Nb, and V to provide a fine-grained microstructure, said article having been first subjected to a pretreatment comprising heating and hot working at a temperature greater than about 1200° C. followed by accelerated cooling, a subsequent subcritical anneal at about 700° C. followed by an austenitizing treatment at between about 850°–950° C. to avoid the formation of a duplexed grain structure, quenching in a suitable medium and then tempering.

32. The steel article according to claim 31 in the shape of a bar.

33. The steel article according to claim 31 in the shape of a tube.

34. The steel article according to claim 31 in the shape of a rough machined part.

35. The steel article according to claim 31 in the form of a finished machined part.

36. The steel article according to claim 31 in the form of a forged product.

* * * * *